US007296944B2

(12) United States Patent
Steinschaden

(10) Patent No.: US 7,296,944 B2
(45) Date of Patent: Nov. 20, 2007

(54) MARKING INSTRUMENTS AND METHODS OF MANUFACTURING MARKING INSTRUMENTS

(76) Inventor: André R. Steinschaden, 211 Yatch Club Way, Suite 230, Redondo Beach, CA (US) 90277

( * ) Notice: Subject to any disclaimer, the term of this patent is extended or adjusted under 35 U.S.C. 154(b) by 0 days.

(21) Appl. No.: 11/018,544

(22) Filed: Dec. 21, 2004

(65) Prior Publication Data

US 2005/0111899 A1 May 26, 2005

Related U.S. Application Data

(62) Division of application No. 10/354,263, filed on Jan. 29, 2003, now Pat. No. 6,866,439.

(60) Provisional application No. 60/353,001, filed on Jan. 29, 2002.

(51) Int. Cl.
*B43K 7/00* (2006.01)
*B43K 7/03* (2006.01)

(52) U.S. Cl. ..... 401/209; 401/6; 401/48; 401/213; 401/217

(58) Field of Classification Search ..... 401/6, 401/48, 209, 213, 217; D19/41–43
See application file for complete search history.

(56) References Cited

U.S. PATENT DOCUMENTS

| | | | |
|---|---|---|---|
| 42,599 | A | 5/1864 | Rose |
| 825,985 | A | 7/1906 | De Schwertenberg |
| 1,486,294 | A | 3/1924 | Morris |
| D77,800 | S | 2/1929 | Vredenburgh |
| 2,372,777 | A | 4/1945 | Gorman |
| 3,168,072 | A | 2/1965 | Nitta |
| D207,563 | S | 5/1967 | Bailey |
| 3,747,121 | A | 7/1973 | Siden |
| 3,994,605 | A | 11/1976 | McKnight |
| D254,677 | S | 4/1980 | Burrows |
| 4,227,823 | A | 10/1980 | Kitzerow |

(Continued)

FOREIGN PATENT DOCUMENTS

DE 37 35 991 A1 5/1988

(Continued)

OTHER PUBLICATIONS

International Search Report in corresponding PCT Application No. PCT/US03/02805 dated Jul. 25, 2003.

(Continued)

*Primary Examiner*—Tuan Nguyen
(74) *Attorney, Agent, or Firm*—Knobbe, Martens, Olson & Bear, LLP

(57) ABSTRACT

A handheld marking instrument includes a body having a substantially flat shape, a first chamber formed within the body and having an inner surface configured to receive and contain a marking substance within the body, and a first marking device configured to deliver the marking substance to a desired surface during marking. The first marking device is incorporated in the body and in communication with the first chamber to access the marking substance contained by the inner surface. At least a part of the first marking device is moveable between an exposed position for marking on the desired surface, and a retracted position. In one embodiment, the body has a form factor of a financial transaction card.

14 Claims, 34 Drawing Sheets

U.S. PATENT DOCUMENTS

| | | | |
|---|---|---|---|
| 4,317,638 | A | 3/1982 | Klaber |
| D276,479 | S | 11/1984 | Mori |
| 4,568,213 | A | 2/1986 | Money |
| 4,706,995 | A | 11/1987 | Dopp |
| 4,732,504 | A | 3/1988 | Telli |
| 4,815,880 | A | 3/1989 | Sekiguchi |
| D302,985 | S | 8/1989 | Vinck |
| 4,883,079 | A | 11/1989 | Sakamaki et al. |
| D305,341 | S | 1/1990 | Dolan, Sr. |
| D306,315 | S | 2/1990 | Shintani |
| D310,449 | S | 9/1990 | Agrippino |
| 5,013,173 | A | 5/1991 | Shiraishi |
| D319,467 | S | 8/1991 | Clowes |
| D344,759 | S | 3/1994 | Monzyk |
| D344,977 | S | 3/1994 | Monzyk |
| D344,978 | S | 3/1994 | Monzyk |
| D345,176 | S | 3/1994 | Monzyk |
| D345,375 | S | 3/1994 | Monzyk |
| D365,849 | S | 1/1996 | Greer, Jr. |
| D367,497 | S | 2/1996 | Goetz |
| 5,678,939 | A | 10/1997 | Ross |
| 5,897,261 | A | 4/1999 | Goetz |
| D449,855 | S | 10/2001 | Shamitoff |

FOREIGN PATENT DOCUMENTS

| | | |
|---|---|---|
| DE | 90 10 483 | 7/1990 |
| DE | 3909133 A1 | 9/1990 |
| DE | 200 17 989 U1 | 4/2001 |
| FR | 2 431 377 | 7/1978 |
| GB | 2278810 A | 12/1994 |

OTHER PUBLICATIONS

International Preliminary Examination Report for Int'l Application No. PCT/US/03/02805 dated May 28, 2004.

MARKING INSTRUMENTS AND METHODS OF MANUFACTURING MARKING INSTRUMENTS

PRIORITY APPLICATION

This application is a divisional of U.S. patent application Ser. No. 10/354,263, filed Jan. 29, 2003, now U.S. Pat. No. 6,866,439 which claims priority under 35 U.S.C. §119(e) from U.S. Provisional Application No. 60/353,001, filed Jan. 29, 2002.

BACKGROUND OF THE INVENTION

1. Field of the Invention

The present invention relates to a marking instrument.

2. Description of the Related Art

Marking instruments of all types, three-dimensional shapes, and sizes exist, and may be used for writing and marking on a desired surface. The most common form for a marking instrument is a rigid extended cylindrical shape of varying length and diameter, containing an apparatus to contain a marking substance and/or solid (hereinafter referred to as a "marking substance-containing apparatus"), and an apparatus to suitably deliver the marking substance and/or solid (hereinafter referred to as a "marking substance") to the surface to be written upon or marked (hereinafter referred to as a "marking device" or a "marking solid-delivering apparatus").

Generally, such writing and marking instruments also contain an apparatus to prevent the marking device and/or the marking solid-delivering apparatus from marking surfaces when the writing and marking instrument is not being used, commonly in the form of a capping apparatus or a retracting apparatus. Additionally, common writing and marking instruments often contain an apparatus to attach the writing and marking instrument to clothing worn by the user (hereinafter referred to as an "attachment apparatus"), generally in the form of a semi-rigid clip apparatus.

Common embodiments of such writing and marking instruments are ball point pens, fountain pens, porous-nib pens and markers, mechanical pencils, and various combinations of pens, mechanical pencils and markers. Pens and markers use a variety of suitable inks and marking chemical compounds to mark surfaces. Pencils use a variety of suitable solid marking compounds to mark surfaces (hereinafter referred to as "marking solids").

SUMMARY OF THE INVENTION

The conventional rigid cylinder writing and marking instrument form has several disadvantages. The typical length, volume and rigidity of a writing and marking instrument make it difficult for a writing and marking instrument to be stored in non-rigid small spaces, such as a wallet, or a pocket which is part of the user's clothing. This limits the number of places that a writing and marking instrument can be comfortably and safely carried on one's person, and thus be conveniently continuously available for use. The generally narrow rigid cylindrical form offers only a limited contact surface for the user's hand, increasing the potential for fatigue and "writer's cramp" with prolonged continuous use. The rigidity results in the writing and marking instrument presenting a potential danger to the user, especially children, who can be accidentally poked and injured by the writing and marking instrument during its use, or while playing. The conventional form substantially limits the space available for decorating the writing and marking instrument and for applying information and advertisements.

There is therefore a need for a widely applicable writing and marking instrument which has either a semi-rigid or rigid form that can be more easily and safely stowed on one's person and is thus more conveniently available for use at any time. Accordingly, certain inventive embodiments described herein provide for a writing and marking instrument, as well as a writing and marking instrument which substantially increases the space available for decoration and for the affixing of information and advertisements, and which due to its form, facilitates the application of such decoration, information and advertisements.

Certain embodiments described herein increase the utility of common card-like devices by making it possible to integrate a convenient writing and marking instrument into both financial transaction card-like devices and non-financial transaction card-like devices, such as credit cards, microchip-containing smart cards, cards containing magnetic data storage devices, automatic teller machine (ATM) access cards, radio frequency ("RF") and non-radio frequency access/security cards and entrance tickets, telephone access and stored value cards, stored value gift cards containing monetary value which can be redeemed at business establishments, customer and member "loyalty" cards such as distributed by retail businesses, travel-related businesses (airlines, hotels, auto rental, etc.), clubs, sports and entertainment establishments, wallet cards of photographic images, and similar card-like devices.

Further, certain embodiments utilize a card-like form for a writing and marking instrument, which uniquely offers increased contact surface area with the user's hand without requiring a large three-dimensional geometric volume. These embodiments distribute the muscle strain of holding the writing and marking instrument over a greater contact surface area, and decrease the potential for fatigue and "writer's cramp" with prolonged continuous use.

Certain embodiments further make it possible to integrate a writing and marking instrument into host devices, for example, key chains, clothing or hats, or common hand-held appliances, such as mobile telephones, electronic data devices, mini-computers, cameras, calculators, key chain transmitters, timekeeping devices including wristwatches, and similar devices, such that the writing and marking instrument is conveniently continuously available for use.

Accordingly, in one embodiment, a handheld marking instrument includes a body having a substantially flat shape, a first chamber formed within the body and having an inner surface configured to receive and contain a marking substance within the body, and a first marking device configured to deliver the marking substance to a desired surface during marking. The first marking device is incorporated in the body and in communication with the first chamber to access the marking substance contained by the inner surface. At least a part of the first marking device is moveable between an exposed position for marking on the desired surface, and a retracted position.

In another embodiment, a handheld marking instrument includes a body having a substantially flat shape, a first chamber formed within the body and having an inner surface configured to receive and contain a marking substance within the body, a vent in communication with the first chamber and configured to pass air and to block the marking substance, a first marking device configured to deliver the marking substance to a desired surface during marking. The first marking device is incorporated in the body and in communication with the first chamber to access the marking substance contained by the inner surface. A distal part of the first marking device is exposable for marking on the desired surface.

In a further embodiment, a handheld marking instrument includes a body having a form factor of a financial transaction card, a first chamber formed within the body and configured to receive and contain a marking substance within the body, and a first marking device configured to deliver the marking substance to a desired surface during marking. The first marking device is incorporated in the body and in communication with the first chamber. A distal part of the first marking device is exposable for marking on the desired surface.

In an additional embodiment, a promotional item includes a body having a substantially flat shape for holding between a user's fingers, and having at least one surface with promotional information, and a marking instrument integrated in the body. The marking instrument has a body having a substantially flat shape, a first chamber formed within the body and having an inner surface configured to receive and contain a marking substance within the body, and a first marking device configured to deliver the marking substance to a desired surface during marking. The first marking device is incorporated in the body and in communication with the first chamber to access the marking substance contained by the inner surface. At least a part of the first marking device is moveable between an exposed position for marking on the desired surface, and a retracted position.

In yet another embodiment, a method of manufacturing a handheld marking instrument includes providing a first flat housing part of a first predetermined thickness, forming a first chamber on the first housing part, covering the first chamber and the first flat housing part with a second flat housing part to form a housing, the first chamber within the housing configured to receive and contain a marking substance, and fitting a first marking device to a predetermined location of the housing to place the first marking device in communication with the first chamber.

The various embodiments of the marking instrument may be manufactured by injection molding a body having a flat shape, e.g., a card-like shape or a coin-like shape, or forming the body by lamination.

In some embodiment, the card-like shape of the body corresponds in length, width, and height approximately to the size of a financial transaction card. In other embodiments the length and width of the body correspond approximately to the size of a financial transaction card, but the thickness of the body is greater than that of a financial transaction card. For example, the thickness of the body can be 1.5 times, 2 times, 2.5 times, 3 times, or greater than 3 times the thickness of a financial transaction card. Similarly, in other embodiments the length of the body can be shorter or longer than that of a financial transaction card and the width of the body can be smaller or greater than that of a financial transaction card.

In one embodiment, the body has a first surface and a second surface, wherein at least one of the surfaces includes at least one of graphics, advertisement and information.

In one embodiment, the body is manufactured by a lamination process using heat, adhesives such as commercially available epoxies and glues, lasers, or other suitable methods.

BRIEF DESCRIPTION OF THE DRAWINGS

These and other aspects, advantages, and novel features of the invention will become apparent upon reading the following detailed description and upon reference to the accompanying drawings. In the drawings, same elements have the same reference numerals.

DETAILED DESCRIPTION OF CERTAIN INVENTIVE EMBODIMENTS

Marking Instrument Bodies

Figure 1:
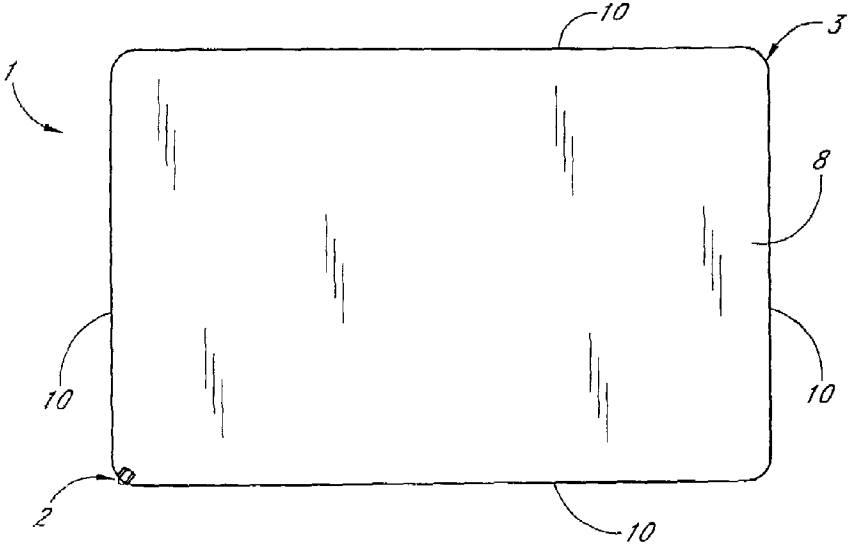
FIG. 1 is a perspective view of a marking instrument contained in a card-like device, showing one marking device.
Figure 2:
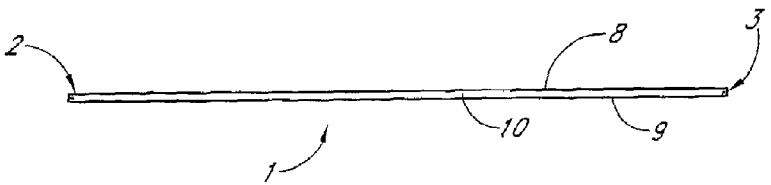
FIG. 2 is a side edge elevation view thereof.

Certain embodiments of the invention may be in a relatively flat form that can be financial transaction card-like in its body dimensions. FIG. 1 and FIG. 2 show an embodiment of a marking instrument contained in a card-like device. Depending on the particular use or uses, the embodiment shown in FIG. 1 and FIG. 2, and all other embodiments described herein, may also be referred to as a marking instrument or writing instrument. The marking instrument has a body 1 that has a thickness of about 5 mm or less, and in certain embodiments about less than 1 mm. In the illustrated embodiment, the body 1 is in a form of a flat card with dimensions approximately like a conventional financial transaction card. For example, the card has a body 1 with a length of about 86 mm, width of about 54 mm and thickness of about 0.76 mm.

FIG. 1 shows the body 1 containing one marking device 2 which delivers the marking substance contained in the body 1 to the surface to be written upon or marked. FIG. 1 also shows the body 1 containing one venting apparatus 3, which opens up to one edge surface 10. The venting apparatus 3 is contemplated to be optional for certain embodiments to facilitate the flow of marking substance to and through the marking device 2. In all embodiments described hereinafter the venting apparatus 3 is optional. FIG. 1 also shows one decoratable body top surface 8. FIG. 2 shows all the elements shown in FIG. 1 and also one decoratable body bottom surface 9.

In other embodiments the body can contain more than one suitably located marking device and can contain more than one venting apparatus. For example, a body such as shown in FIG. 1 can contain a marking device in each corner, each of which can deliver the same type and color marking substance as delivered by 2, or each of which can deliver a marking substance of a type and/or color different from that delivered by 2.

In other embodiments the body can contain one or more than one marking solid-containing apparatus, which contains a marking substance such as a pencil lead, and the body can contain one or more than one marking solid-delivering apparatus which serves to suitably retain the marking solid(s) for marking.

In other embodiments the body can jointly contain any number of marking substances, that are contained by any number of marking substance-containing apparatuses, and that are delivered by any number of marking substance-delivering mechanisms.

Figure 13:
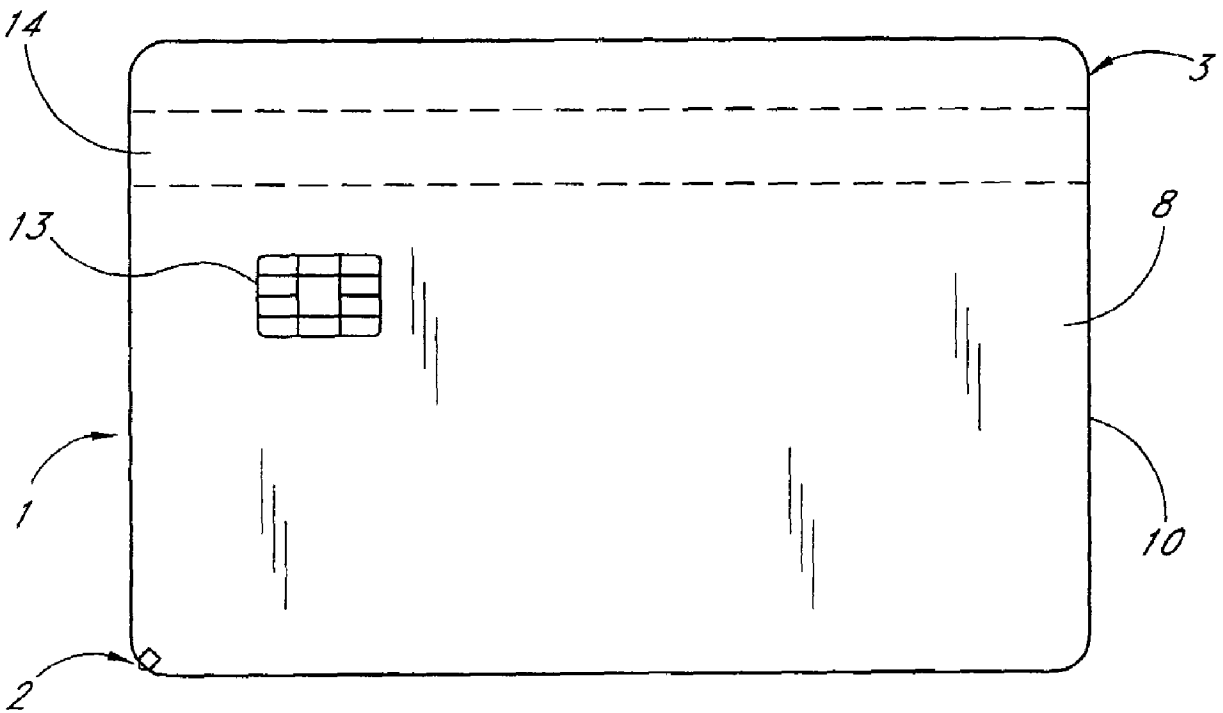
FIG. 13 is a top plan view of a marking instrument contained in a smart card containing a microchip data device covered by an electrically conducting contact surface, and with a magnetic data strip (on the rear side)

In another embodiment, FIG. 13 shows one embodiment of a smart financial transaction card containing a microchip data device (not shown) in direct contact with, and covered by an electrically conducting contact surface 13, and containing a magnetic data strip 14 on the rear side (and therefore shown in dashed lines). However, it is contemplated that a financial transaction card can include either the microchip data device, or the magnetic data strip 14. FIG. 13 shows one marking device 2 and one venting apparatus 3.

Figure 14:
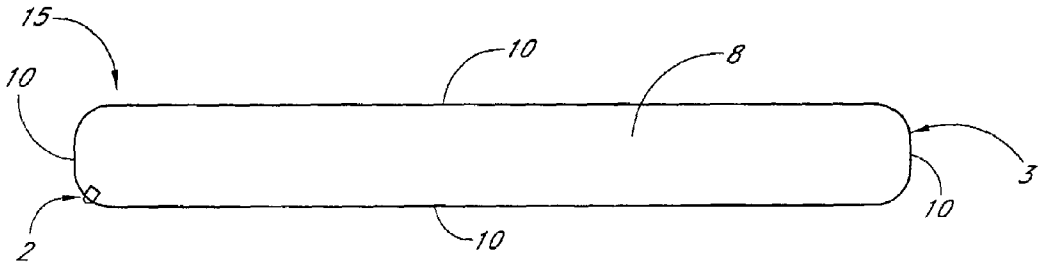
FIG. 14 is a top plan view of a longitudinal fractional financial transaction card-like body form marking instrument showing one marking device.
Figure 15:
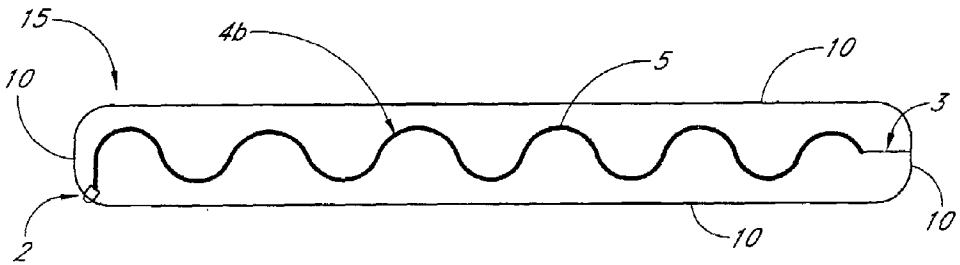
FIG. 15 is a longitudinal sectional view of a longitudinal fractional financial transaction card-like body form marking instrument showing an embossed reservoir-like chamber for marking substance.

Other inventive embodiments can be in the form of a part of the conventional financial transaction card form, such as a longitudinal section or slice of the conventional financial transaction card form, hereinafter referred to as "fractional financial transaction card-like body forms". FIG. 14 and FIG. 15, for example, show embodiments of a fractional financial transaction card-like body form 15, which approximates a one-sixth longitudinal slice of a whole financial transaction card form, with each embodiment containing one marking device 2 and one venting apparatus 3.

Certain other embodiments can be constructed of two or more fractional financial transaction card-like body forms, which when placed together or attached together in a mosaic or puzzle-like manner, can comprise a full-size conventional financial transaction card-like form.

Figure 28:
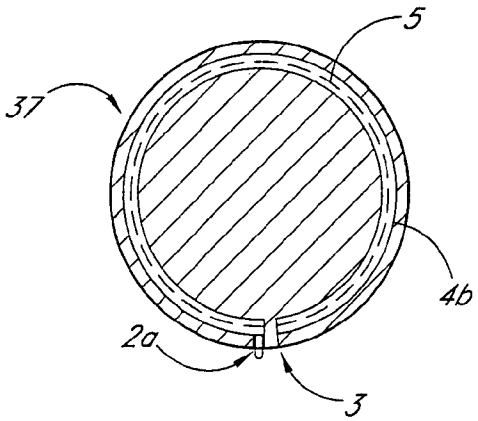
FIG. 28 is a top sectional view of a coin-form marking instrument showing a marking substance-containing apparatus in the form of an embossed reservoir-like chamber, and one marking device.
Figure 27:
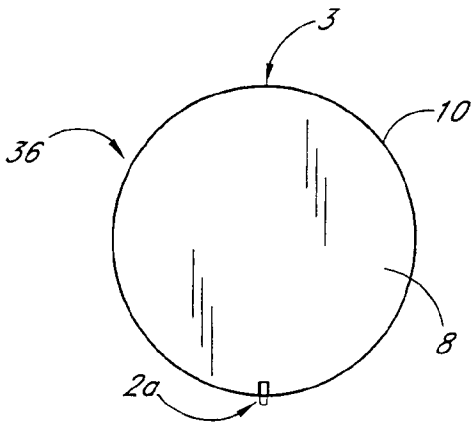
FIG. 27 is a top plan view of a coin-form marking instrument containing an interior marking substance-containing apparatus similar to that shown in FIG. 3.

Other inventive embodiments may have a coin-like form. FIG. 27 shows a coin-like body form 36 containing one marking device 2*a*, one venting apparatus 3, and one decoratable body top surface 8. FIG. 28 shows a coin-like form 37 containing one marking device 2*a*, one marking substance-containing apparatus 4*b* in the form of an embossed reservoir-like chamber that contains a marking substance 5, and a venting apparatus 3. It is contemplated that other embodiments of a coin-like form can be polygonal in shape, or they can be of a shape that is a combination of a partial circular form and a polygonal shape, or they can be any other suitable coin-like shape.

Figure 30:
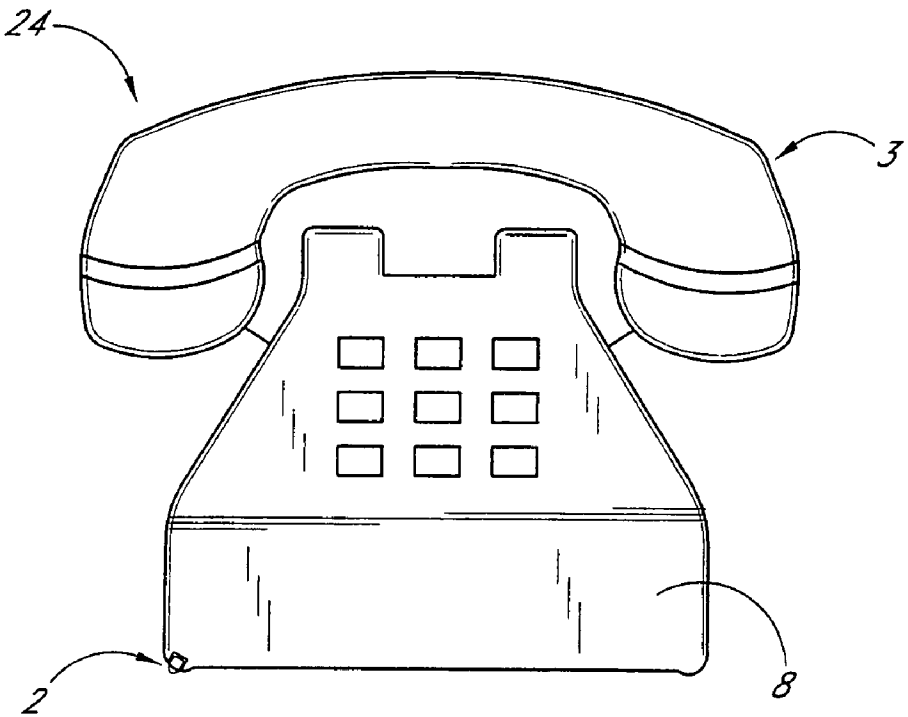
FIG. 30 is a top plan view of a commercially desirable telephone form marking instrument showing one marking device.

Yet other embodiments of the invention can be any other ergonomic and/or commercially desired relatively flat or non-flat body form, with varying length, width and thickness, such as potentially commercially desirable theme-based shapes such as a telephone-like body form embodiment shown in FIG. 30. FIG. 30 shows a telephone-like body form 24 marking instrument containing one marking device 2, one venting apparatus 3, and one decorated body top surface 8.

Figure 31:
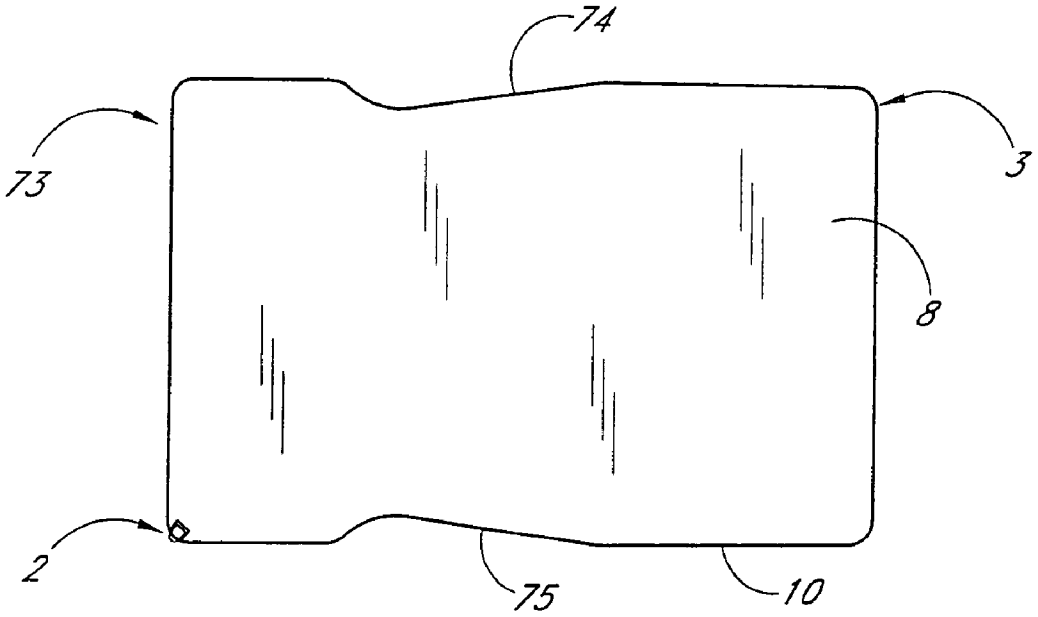
FIG. 31 is a top plan view of an ergonomically shaped marking instrument showing one marking device.

The body can contain any suitable concave or convex shape, or shapes, on its various surfaces in order to provide an ergonomic shape and feel which provides user comfort during marking. FIG. 31 shows an embodiment of an ergonomically shaped body form 73 which contains indentations 74 and 75 which serve as finger rests for the user providing a comfortable grip of the body.

The body can contain a retracting apparatus for one or more of the apparatuses that deliver the marking substance and/or the marking solid to the surface to be written upon or marked. The retracting apparatus may retract the marking device when the marking instrument is not in use.

Alternative to the retracting apparatuses, or in combination with the retracting apparatuses, the body can contain one or more capping apparatuses which enable the user to prevent the marking devices and/or the marking solid-delivering apparatuses from marking surfaces when the marking instrument is not in use. The body can contain a capping apparatus in a form that is integrated with and permanently attached to the body, such as the embodiment shown in FIG. 19, which shows an oblong circular capping apparatus 18 which can swing from a capping to an uncapping position relative to the marking device 2, along a swing arc enabled by attachment point and pivot 19.

The body can contain one or more apparatuses enabling attachment of the marking instrument to a pocket or similar item, or to a key ring, lanyard, or similar device. Such attachment apparatus can be in the form of a clip apparatus which is integrated with and permanently attached to the body, such as the embodiments shown in FIG. 22 and FIG. 23, and in FIG. 24 and FIG. 25, or which can be formed from the body by suitably die stamping or die cutting the body. The body can also contain an attachment apparatus in the form of one or more holes in the body which are suitably placed and of suitable geometric shape such that they serve as a connecting point through which a device such as a key ring or lanyard can be passed and attached.

Figure 26:
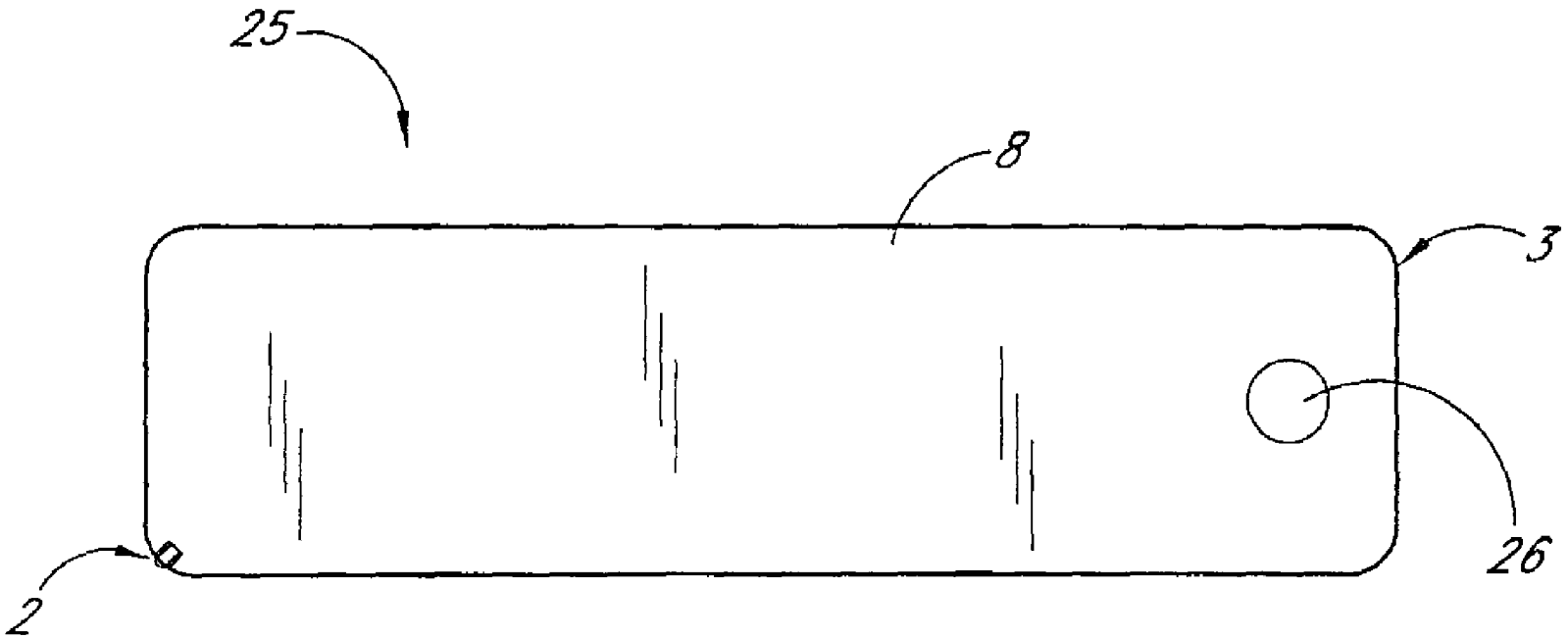
FIG. 26 is a top plan view of a longitudinal fractional financial transaction card-like body form marking instrument containing an attachment apparatus in the form of a hole in the body, for attachment to a key ring or similar device.

FIG. 26 shows an embodiment of a fractional financial transaction card-like body form marking instrument 25, which approximates a one-half longitudinal slice of a whole financial transaction card form, and which contains one marking device 2, one venting apparatus 3, one decoratable body top surface 8, and one approximately 5 mm diameter hole 26 for attachment to a key ring or similar device. If the original whole card is of different dimensions, it is contemplated that the one-half longitudinal slice will also be of different dimensions.

In other embodiments, the body can contain magnets, magnetic materials such as magnetic strips and tapes, magnetic coatings, magnetic liquids such as magnetic water or magnetic oils, adhesives, hook and loop fasteners or similar devices to enable attachment of the marking instrument to various surfaces and objects.

The material from which the body of the marking instrument is made can be either plastic, such as PVC or ABS; rubber, such as a silicone compound; metal, such as a stainless steel or a brass, or a tempered stainless steel or brass; wood; any composite of one or more of these materials; or any other suitable material in order to achieve suitable properties such as durability, semi-rigidness or rigidness, surface texture and color. Certain embodiments can utilize highly elastic metal materials, such as nickel titanium, as components for the body. Certain embodiments can utilize materials for the body which are recyclable, such as ABS plastics and rubbers. Certain other embodiments can utilize materials for the body which are biodegradable, such as common starches, such as corn, wheat and potato starch, or such as natural resins and gums.

The body can be constructed by various manufacturing methods. The body can be injection molded in one piece, with the marking substance-containing apparatuses and the marking devices, and any retracting apparatuses, capping apparatuses, and/or attachment apparatuses serving as component inserts in the injection molding process ("insert molding"), and as such being suitably molded into place by injecting plastic, rubber, foam, or a suitable composite around them. Alternatively, the body can be constructed of two or more injection molded pieces or layers, that are then joined together using various methods such as laminating using heat, adhesives such as commercially available epoxies and glues, lasers, or other suitable methods, to form one permanent or semi-permanent whole piece.

Alternatively, the body can be laminated, either individually, or multiply in a larger sheet-like array, using two or more layers of suitable material, between which the marking substance-containing apparatuses and marking devices (and/or the marking solid-containing and marking solid-delivering apparatuses), and any retracting apparatuses, capping apparatuses, and/or attachment apparatuses are suitably laminated into place with suitably formed layers of plastic, rubber, metal, wood or composites. The body construction can be laminated using heat, adhesives such as commercially available epoxies and glues, lasers, or other suitable methods. If laminated in a larger sheet-like array in order to laminate multiple bodies simultaneously, the sheet-like array can then be, for example, suitably die cut or die stamped in order to produce the individual bodies.

Figure 6:
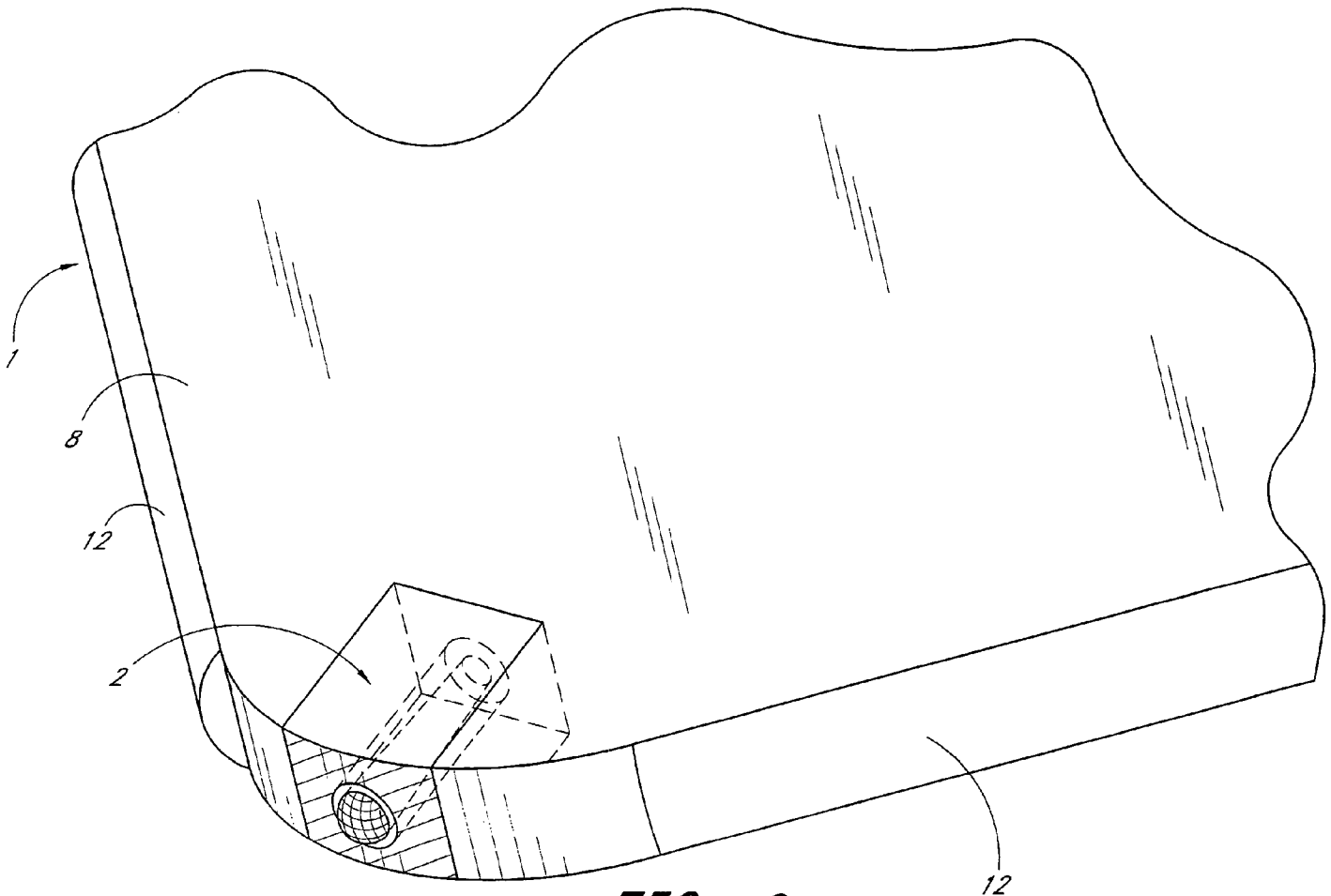
FIG. 6 is an enlarged side edge perspective view of a rounded body edge.
Figure 32:
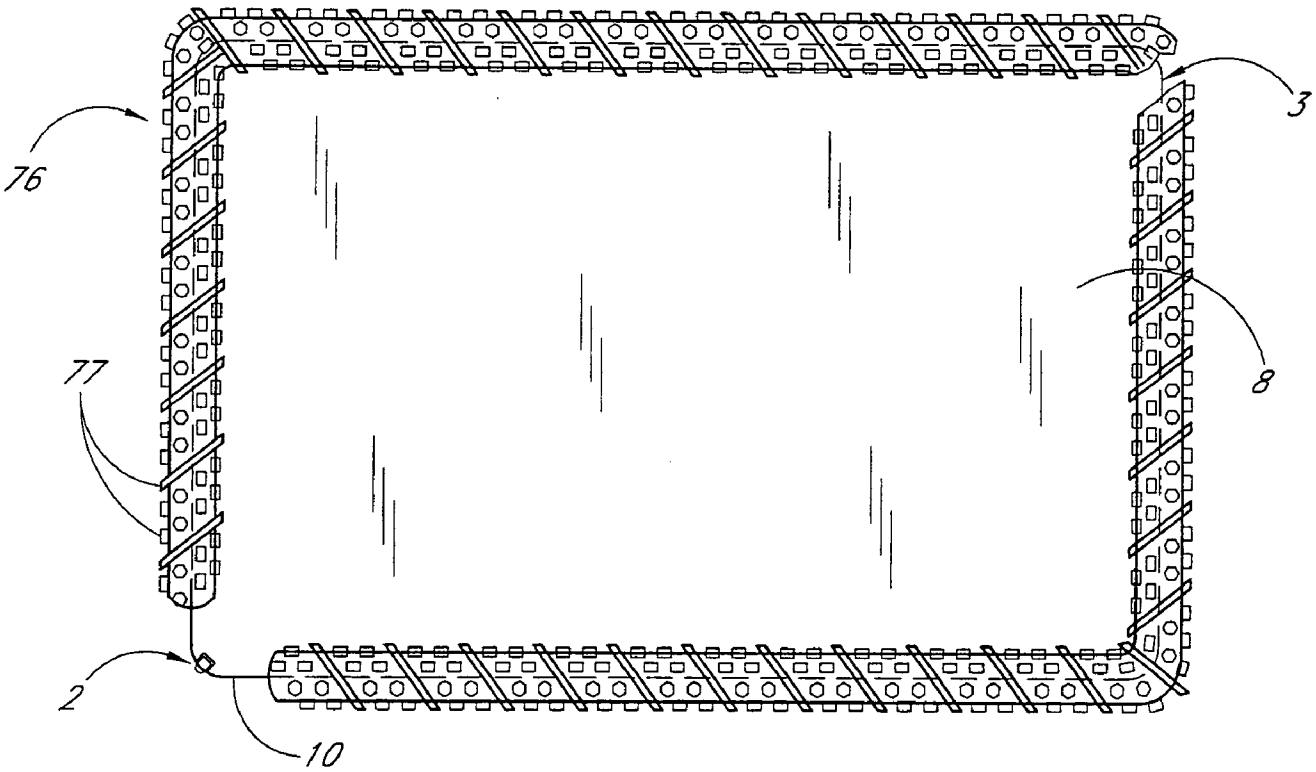
FIG. 32 is a top plan view of a marking instrument showing one marking device, and a functional and decorative rubberized tire tread-like attachment around the edge perimeter.

Some or all of the edges of the body can be suitably rounded to provide a more ergonomic shape and feel which increases user comfort during marking. FIG. 6 shows an enlarged side edge perspective view of a card corner containing a marking device 2 with both straight edges 12, which are leading away from the corner arc of the body, being of a rounded form. The body edges can be rounded in the injection molding manufacturing method by using a molding die that has rounded edges in the molding cavity. In the lamination manufacturing method the body edges can be rounded by using a suitable forming die with rounded edges, or by milling the edges round. Alternatively, a rounded edge can be formed by adding a suitable rounded material, such as a convex molding, to the edges of the body. This rounded material can be attached to the body using various methods, such as laminating using heat, adhesives such as commercially available epoxies and glues, coatings, lasers, or other suitable methods. Such rounded material can be a rubber-like material which serves to provide a soft ergonomic feel to the user, and also provides a non-slip surface which enhances the user's grip on the body. FIG. 32 shows an embodiment 76 of a functional and decorative rubberized tire tread-like attachment around the edge perimeter, which serves as a gripping and protective surface.

For use as a promotional item, the body can be decorated, on one or more surfaces, via the application of graphics (designs, photographic and artistic images, holograms, lenticular images, etc.), information and advertisements. These decorations can be applied via conventional printing methods (such as offset, silk screening, thermal, indigo process, digital printing, laser marking, etc.), lamination, adhesive films and labels, or other suitable methods. Additionally, the body can have materials or coatings applied to it that provide commercially appealing textured surfaces, such as a rubberized non-slip coating or surface, such as a silicone or a neoprene, or an applied textile-like fabric surface.

Figure 34:
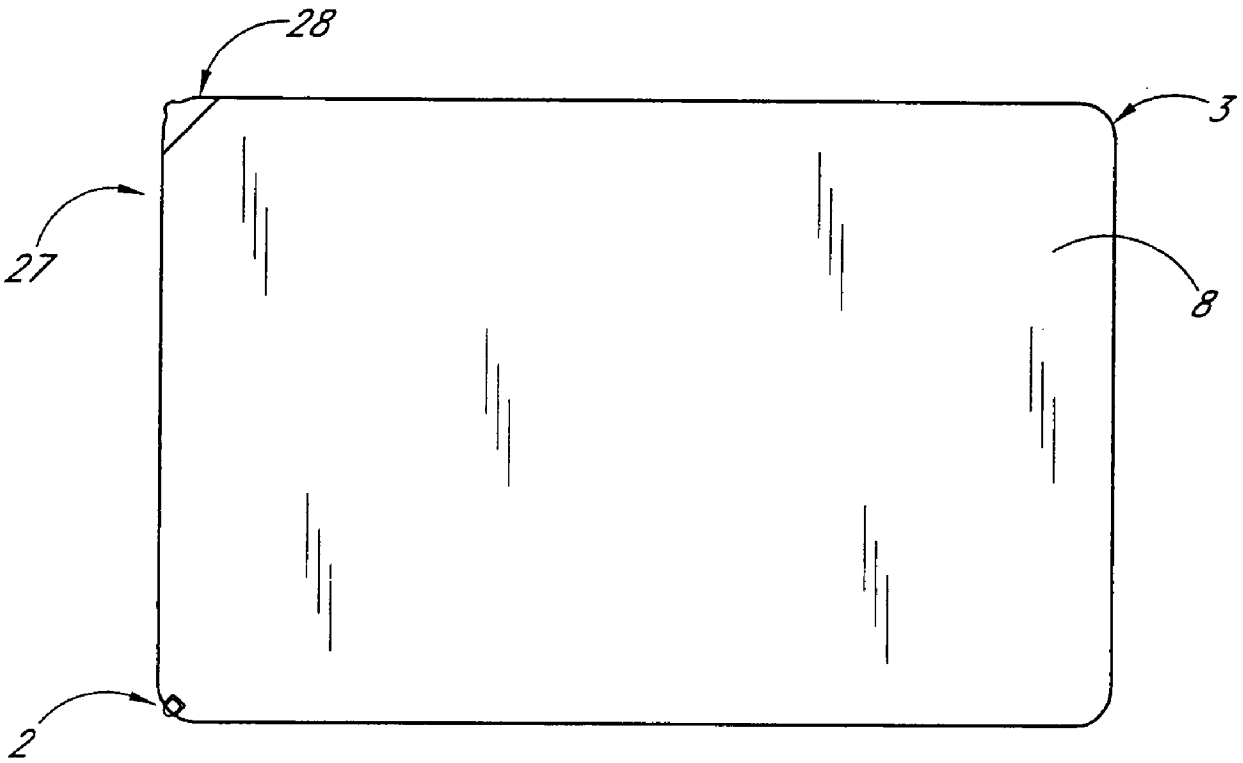
FIG. 34 is a top plan view of a combination marking instrument contained in a card-like device showing one marking device and one stylus-like pointing apparatus.

In addition to constituting a marking instrument, the body 1 can also contain mechanical or electronic components and devices which offer additional functionality and utility resulting in combination devices offering various features. For example, the body 1 may contain a stylus-like pointing device for the touch screens of electronic data devices. FIG. 34 shows a combination marking instrument contained in a financial transaction card-like body form 27 containing one marking device 2, one venting apparatus 3, one stylus-like pointing apparatus 28, and one decoratable body top surface 8. The stylus-like pointing apparatus can be formed such that the surface of the tip or nib that is used to make contact with the touch screen surface of the electronic data device is smooth and approximates a hemispherical shape of suitable radius such as is conventionally used for stylus-like pointing devices. This shape enables the tip to glide on the touch screen surface of the electronic data device, thereby selectively actuating microswitches therein, without damaging the touch screen surface. The material from which the stylus-like tip or nib is formed can be the same material as that of the body, or it can be any other suitable material, such as a Teflon plastic, that is permanently fused to the material constituting the body using various methods such as laminating using heat, adhesives such as commercially available epoxies and glues, lasers, or other suitable methods.

Figure 36:
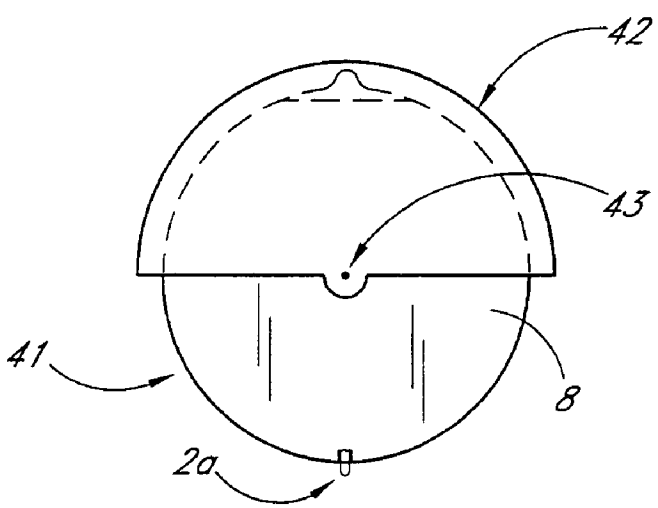
FIG. 36 is a top plan view of the combination coin-form marking instrument shown in FIG. 35, housed in a rotating capping apparatus.
Figure 35:
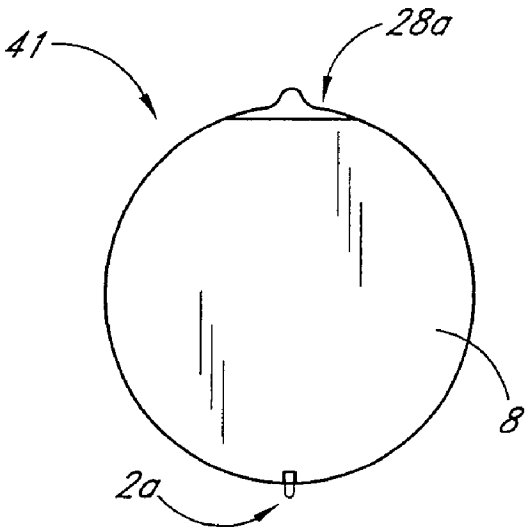
FIG. 35 is a top plan view of a combination coin-form marking instrument showing one marking device and one stylus-like pointing apparatus.

In another embodiment, FIG. 35 shows a coin-form combination marking instrument 41 containing one marking device 2*a*, one stylus-like pointing apparatus 28*a*, and one decoratable body top surface 8. FIG. 36 shows the marking instrument 41 housed in a rotating capping apparatus consisting of a semicircular enveloping housing 42 which a user can suitably rotate on the fixed pivot 43, alternately exposing the marking device 2*a* and the stylus-like pointing apparatus 28*a*.

Figure 39:
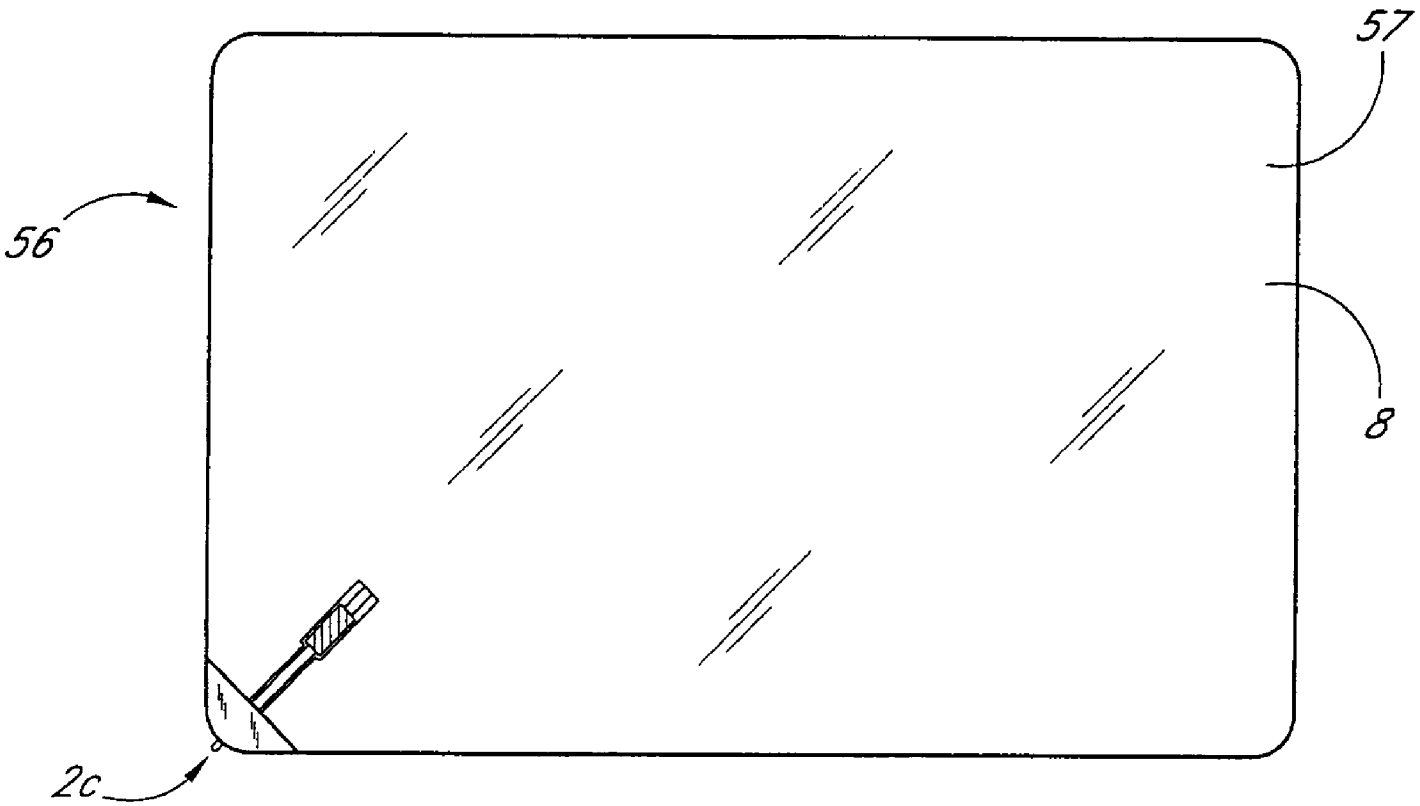
FIG. 39 is a top plan of a combination marking instrument and mirror-like reflecting surface in a card-like device, containing a retractable marking device.

Further, the body 1 may contain a mirror. FIG. 39 shows a combination marking instrument contained in a financial transaction card-like body form 56 containing one rotation-retractable marking device 2*c*, and one decoratable body top surface 8 which contains an edge-to-edge mirror-like reflecting surface 57. Such mirror-like reflecting surface can be created with a suitable metal coating or a metalized foil which can be applied to the body as its top surface. Alternatively, the mirror-like reflecting surface can be contained on a layer under the body top surface, in which case it can be protected by a layer of suitable clear material which can be permanently affixed over it.

Figure 40:
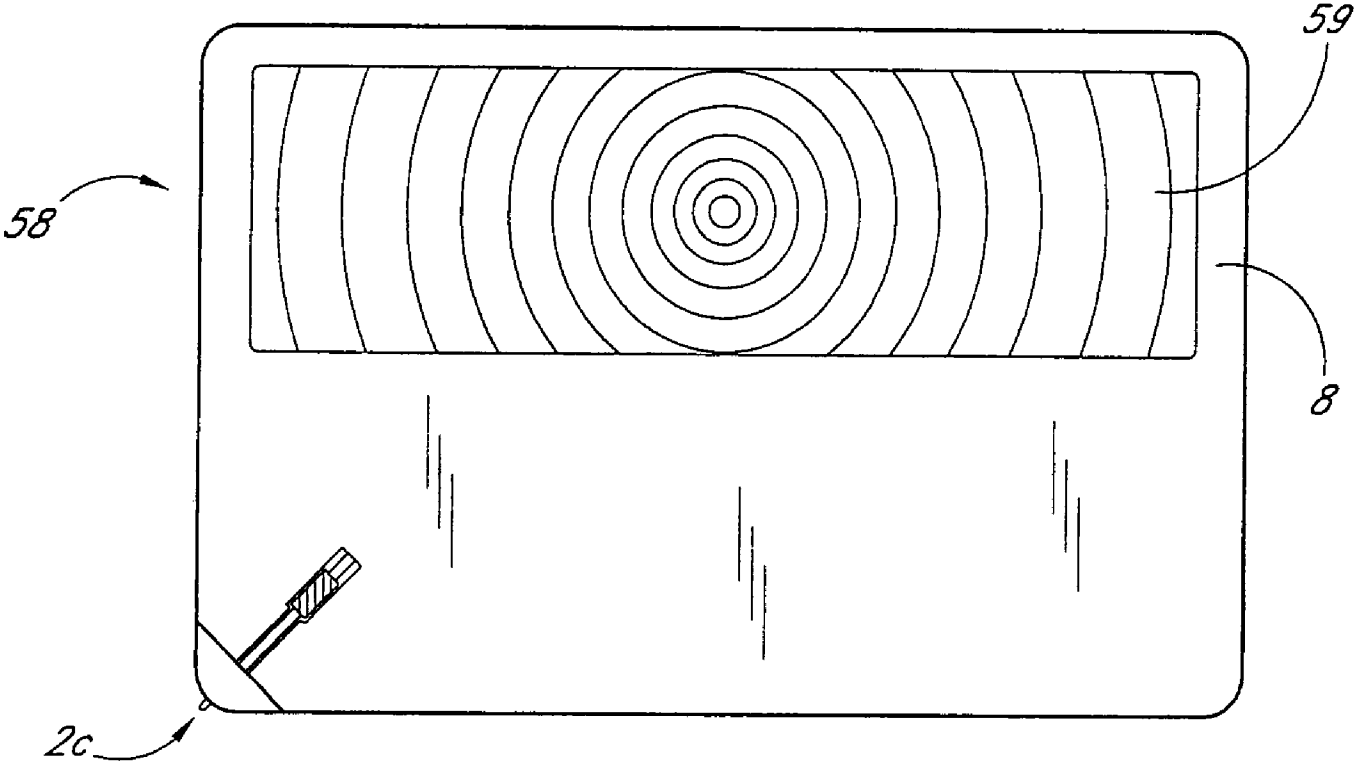
FIG. 40 is a top plan view of a combination marking instrument and integral magnifying lens in a card-like device, containing a retractable marking device.

In another embodiment, the body 1 may contain a magnifying lens. FIG. 40 shows a combination marking instrument contained in a financial transaction card-like body form 58 containing one rotation-retractable marking device 2*c*, one decoratable body top surface 8, and a fresnel-type magnifying contour lens 59. Such a fresnel-type magnifying contour lens can be manufactured by using a clear, transparent material for the body, machining a shallow cavity in the body, partially filling the cavity with a radiation curable liquid resin, impressing a lens pattern on the surface of the resin with a die, and exposing the resin to radiation of sufficient intensity to cure the resin.

Figure 41:
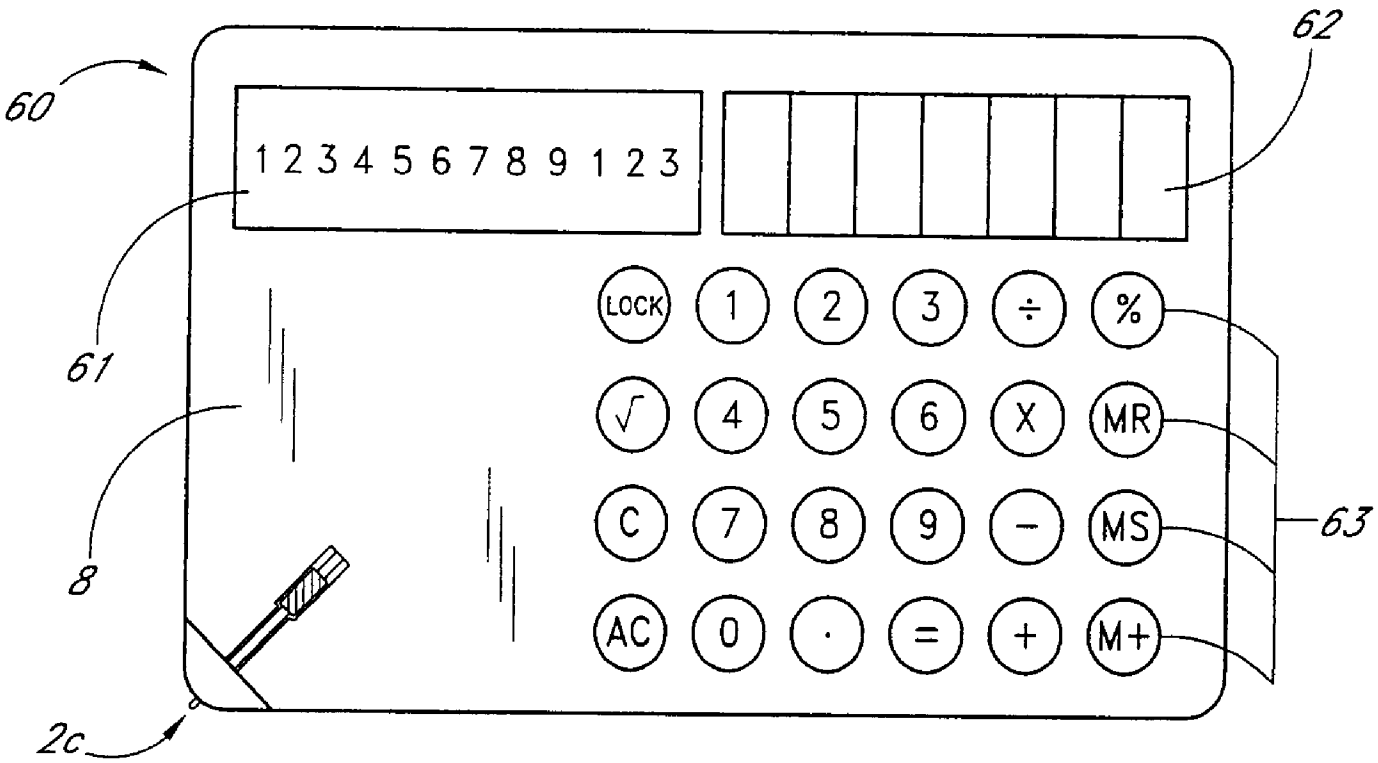
FIG. 41 is a top plan view of a combination marking instrument and electronic calculator in a card-like device, containing a retractable marking device.

Also, the body 1 may contain and a solar or battery powered calculator. FIG. 41 shows a combination marking instrument contained in a financial transaction card-like body form 60 containing one rotation-retractable marking device 2*c*, one decoratable body top surface 8, and a solar-powered calculator. The calculator contains a display 61 for arithmetic digits, a panel of solar cells 62, and a variety of touch-sensitive buttons 63 for entering digits and functions.

Figure 42:
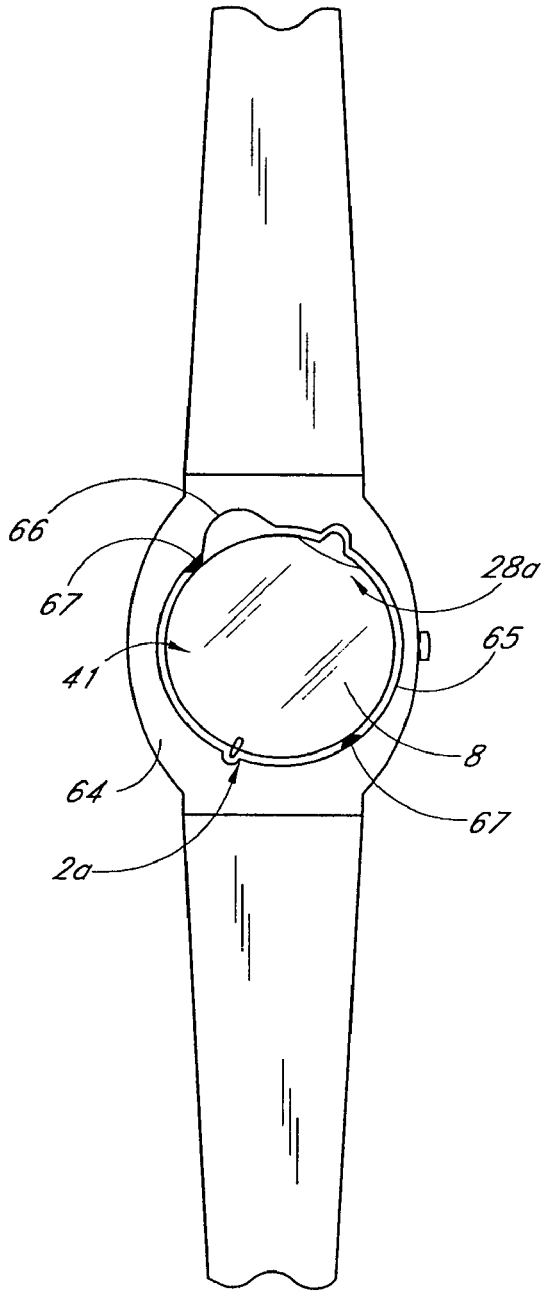
FIG. 42 is a top plan view of a combination marking instrument and wristwatch device, containing a coin-form combination marking instrument and stylus-like pointing apparatus, with one marking device.

Additionally, the body of the marking instrument can be combined with, and physically integrated with various host devices, such as clothing, hats and handheld devices, increasing the utility of such devices to the user. For example, the instrument may be integrated with a wristwatch as a host device. FIG. 42 shows a combination marking instrument and wristwatch device, containing the coin-form marking instrument and stylus-like pointing apparatus embodiment 41 shown in FIG. 35. In FIG. 42, the combination marking instrument and stylus-like pointing apparatus embodiment 41 is integrated into the rear side of a common wristwatch case 64, by means of a form-fitting recess 65 in the wristwatch case. Two retaining tabs 67 in the case hold the marking instrument in place when it is not in use, while an enlarged recess 66 in the case facilitates separation of the marking instrument from the watch case for use, by means of a fingertip, or a fingernail. The body top surface 8 of the marking instrument and stylus-like pointing apparatus embodiment 41 is decoratable.

Figure 43:
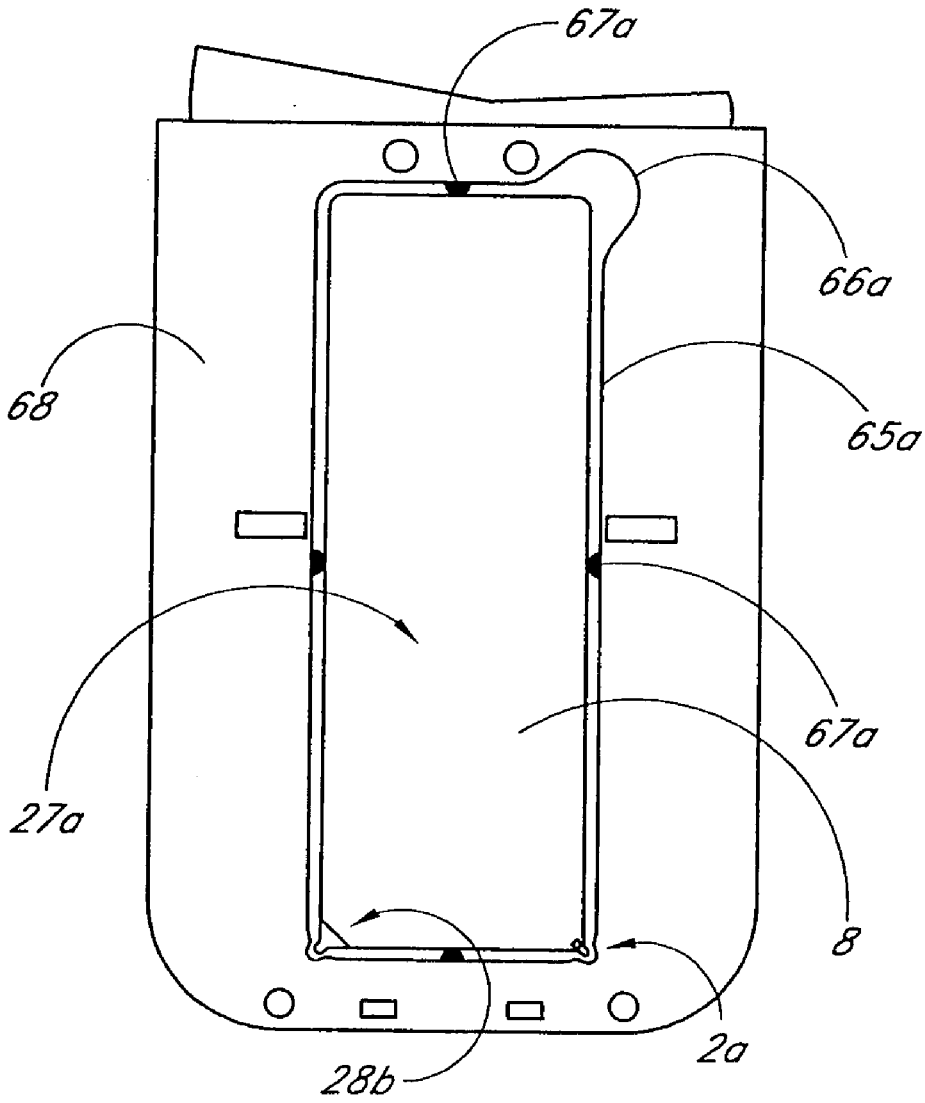
FIG. 43 is a top plan view of a combination marking instrument and electronic data device, containing a combination marking instrument and stylus-like pointing apparatus, with one marking device.

Further, the marking instrument may be integrated with an electronic data device as a host device. Similar to the embodiment shown in FIG. 42, FIG. 43 shows a combination marking instrument and electronic data device, with the data device in the form of a common palm- or handheld computing device. A custom-size embodiment of a combination marking instrument and stylus-like pointing apparatus 27*a*, similar to the embodiment 27 shown in FIG. 34, is shown integrated into to the rear case 68 of the palm-/handheld computing device, by means of a form-fitting recess 65*a* in the rear case. Four retaining tabs 67*a* in the rear case hold the combination marking instrument and stylus-like pointing apparatus in place when it is not in use, while an enlarged recess 66*a* in the rear case facilitates separation of the combination marking instrument and stylus-like pointing apparatus from the rear case for use, by means of a fingertip, or a fingernail. The body top surface 8 of the combination marking instrument and stylus-like pointing apparatus embodiment 27*a* is decoratable.

Figure 7:
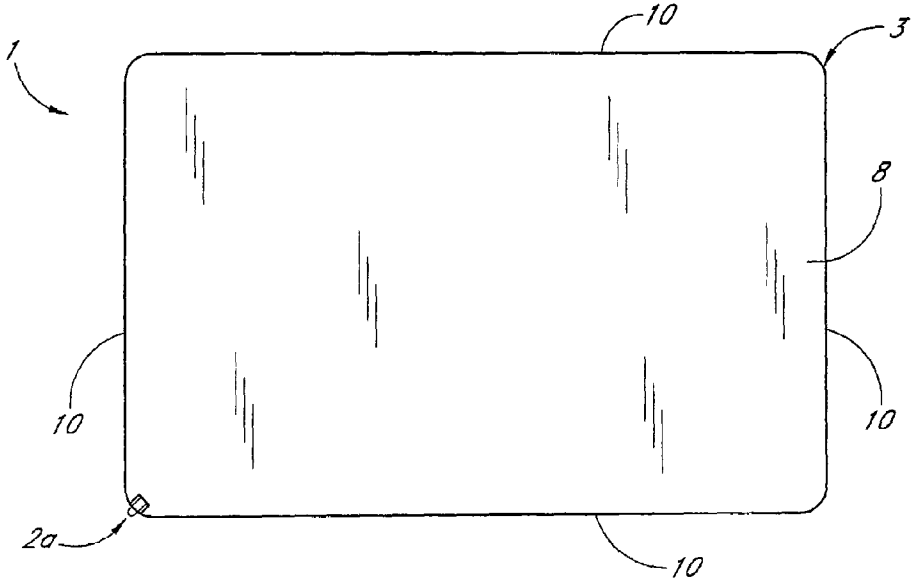
FIG. 7 is a top plan view of a marking instrument contained in a card-like device, showing another embodiment of one marking device.
Figure 8:
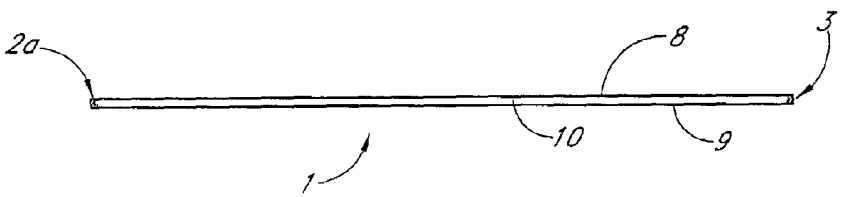
FIG. 8 is a side edge elevation view thereof.
Figure 44:
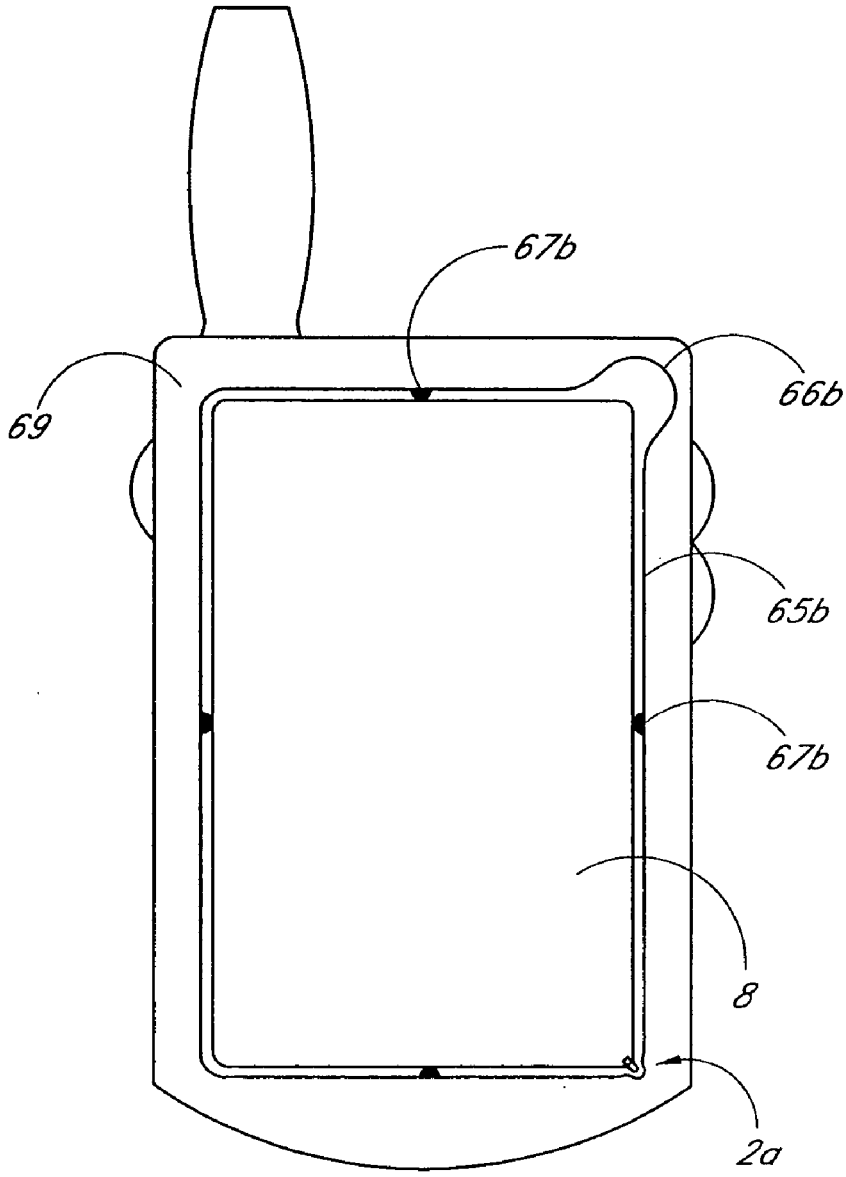
FIG. 44 is a top plan view of a combination marking instrument and mobile telephone device, containing one marking device.

Further, the marking instrument may be integrated with a mobile phone as host device. Similar to the embodiments shown in FIG. 42 and FIG. 43, FIG. 44 shows a combination marking instrument and mobile phone, with the mobile phone in the form of a flip-style pocket phone. A custom-size embodiment of a combination marking instrument, similar to the embodiment shown in FIG. 7, is shown integrated into the rear case 69 of the flip-style pocket phone, by means of a form-fitting recess 65*b* in the rear case. Four retaining tabs 67*b* in the rear case hold the marking instrument in place when it is not in use, while an enlarged recess 66*b* in the rear case facilitates separation of the marking instrument from the rear case, by means of a fingertip, or a fingernail, for use. The body top surface 8 of the marking instrument embodiment is decoratable.

Further, the marking instrument may contain at least one of an embedded antenna, a battery, an electronic display, and a coding pattern.

Figure 3:
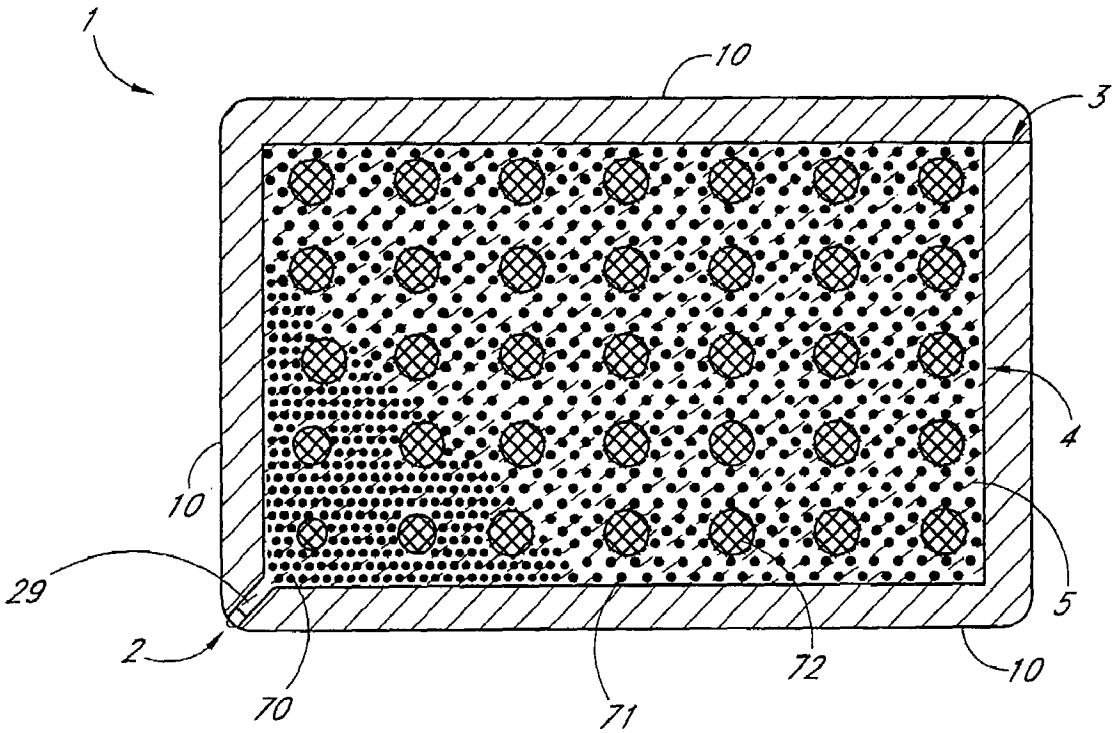
FIG. 3 is a longitudinal sectional view of the embodiment shown in FIG. 1, showing the marking substance-containing apparatus in fluid communication with the marking device.
Figure 4:
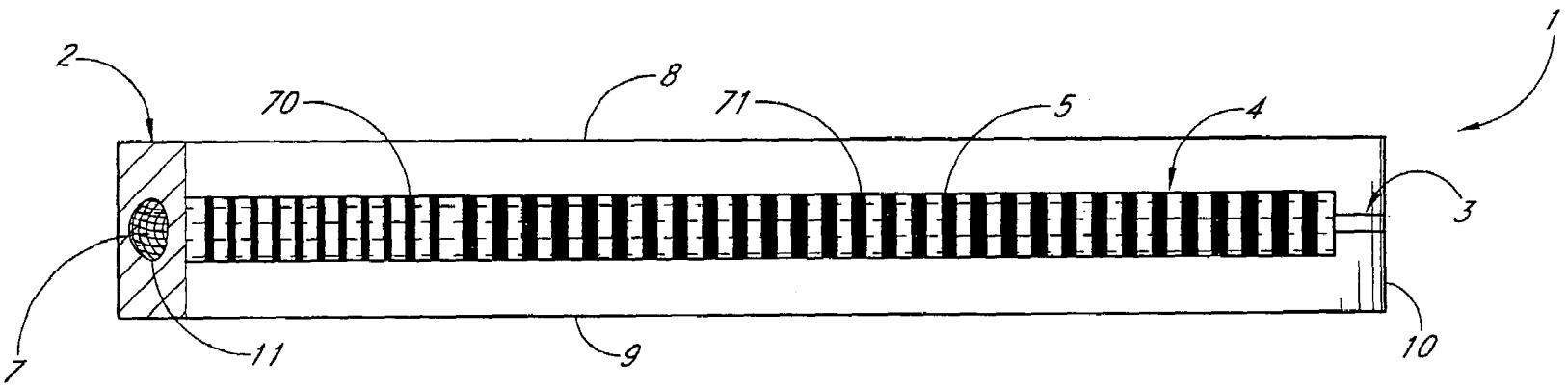
FIG. 4 is an enlarged side edge sectional elevation view (not drawn to scale) of the embodiment shown in FIG. 3 showing the internal elements contained in the body structure.

Marking Substance-Containing Apparatuses, Marking Substances, and Marking Substance Filling Methods The marking instrument can contain one or more than one marking substance-containing apparatus, each of which can contain one or more than one type, and/or one or more than one color of marking substance. Each marking substance-containing apparatus can be in fluid communication with a marking device which serves to deliver the marking substance to the surface to be written upon or marked. FIG. 3 and FIG. 4 show a marking substance-containing apparatus 4 which is connected to, and in fluid communication with, a marking device 2, via a fluid passage 29. The marking device 2 can deliver the marking substance 5 to the surface to be written upon or marked. In one embodiment, the fluid passage is an embossed channel.

Figure 16:
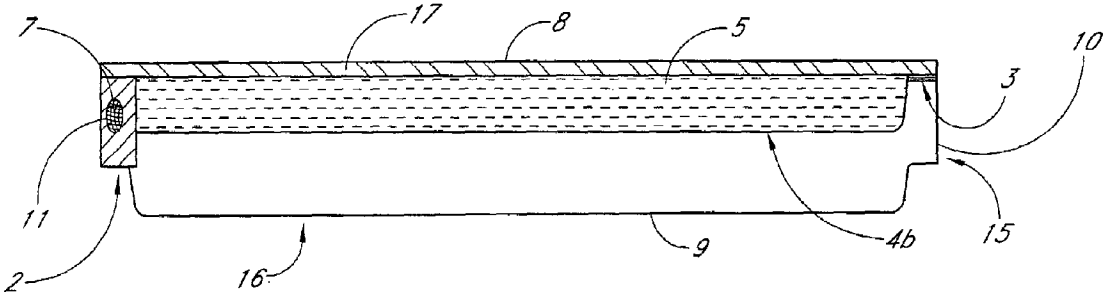
FIG. 16 is an enlarged side edge sectional elevation view (not drawn to scale) of the embodiment shown in FIG. 15, showing an embossed reservoir-like chamber for marking substance.

The marking substance-containing apparatus can be in the form of a reservoir-like chamber, or reservoir-like chambers, which can be in the form of an embossed recess, or embossed recesses, in the body of the marking instrument and which contain a suitable marking substance. FIG. 15 and FIG. 16 show a marking substance-containing apparatus 4*b* that is in the form of a reservoir-like chamber which is in the form of an embossed recess pattern.

The method for forming such recesses to form a reservoir-like chamber, or reservoir-like chambers, or an embossed channel can be similar to the method conventionally used for embossing letters, numbers and symbols onto common financial transaction cards. Once formed, the recesses in the body can be covered by permanently attaching a layer of suitable material over them, thus forming a reservoir-like chamber. The resulting reservoir-like chamber can be filled with marking substance. FIG. 16 shows a body 16 which has been deformed by an embossing method to form the recessed reservoir-like chamber 4*b*, which is then filled with a marking substance 5, which in turn is retained in the recessed reservoir-like chamber 4*b* by a layer of permanently attached suitable material 17.

Alternatively, the marking substance-containing apparatus can be in the form of a reservoir-like chamber in the body of the marking instrument containing a suitable porous material that may be saturated with the marking substance. It is contemplated that the porous material may extend through the fluid passage to connect the reservoir-like chamber with the marking device. The suitable porous material, for example, can be a porous plastic which can have properties of suitable capillarity to ensure that the marking substance collects at the end of the reservoir-like chamber that is connected, directly or through the fluid passage, to the marking device, regardless of the level of marking substance saturation of the porous material.

It is contemplated that the porous material can either be of a homogeneous type, or alternatively, of a heterogeneous type. For example, a heterogeneous porous material may be composed of contiguous strips of different porous materials, each having successively greater capillarity, such that the marking substance is suitably directed to the marking device. The suitable porous material can be, for example, bonded polyethylene fibers, with a pore volume ranging from 25% to 80%, and an average mean pore size ranging from 20 microns to 120 microns, which is conventionally used for marking substance reservoirs in marking instruments. The suitable porous material can be, for example, porous polyethylene sheet, with a pore volume ranging from 35% to 50%, and an average mean pore size ranging from 7 microns to 150 microns, which is conventionally used in wicking applications and liquid reservoir applications. The suitable porous material can be a material which can withstand higher temperatures, for example, porous polytetrafluoroethylene sheet, or glass fiber sheet.

The shape of the reservoir-like chamber and the surface texture of the inner walls can also be constructed in a manner that offers suitable capillarity to ensure flow of the marking substance to the marking device.

Figure 12:
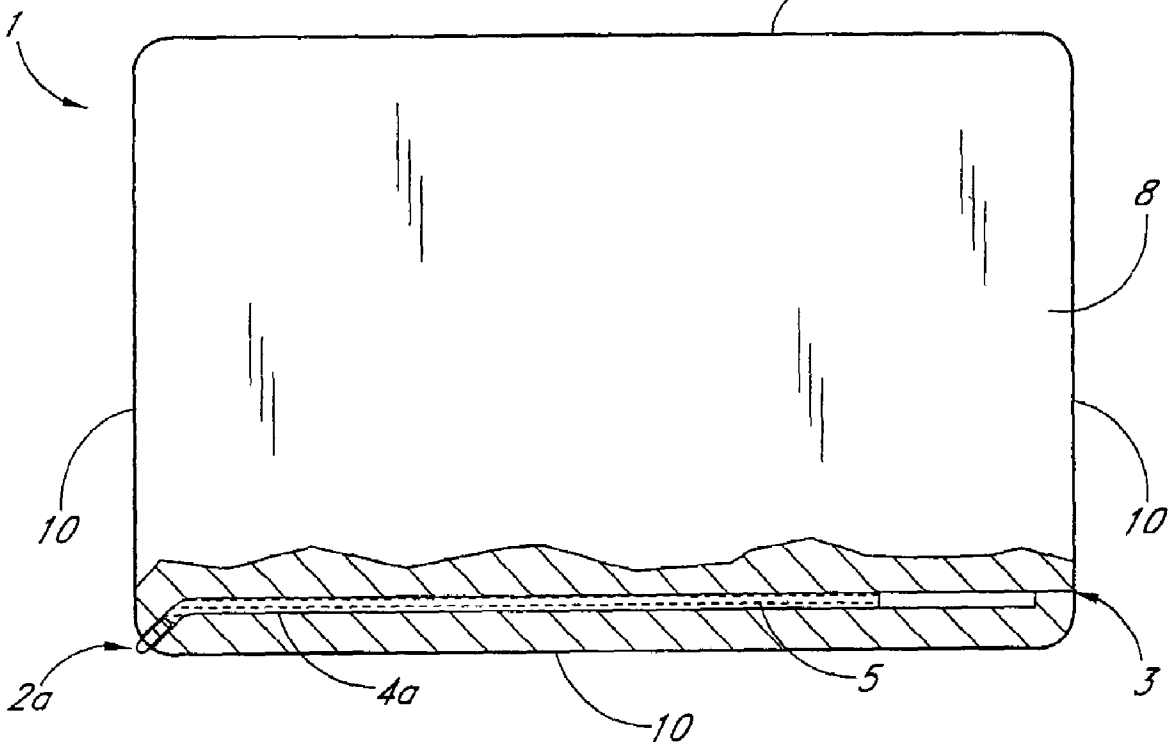
FIG. 12 is a top plan view with a cut away sectional view of a marking instrument, containing a marking substance-containing apparatus and marking device that, in combination, are in the form of a tube-like refill.
Figure 29:
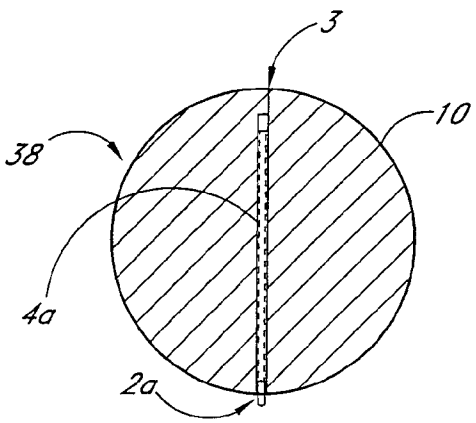
FIG. 29 is a top sectional view of a coin-form marking instrument, containing a marking substance-containing apparatus and a marking device that, in combination are in the form of a tube-like refill.

Alternatively, the marking substance-containing apparatus can be in the form of a reservoir-like chamber which is tube-like and resembles a refill. Such a tube-like chamber can be made of a suitable material, such as an extruded plastic, and can be attached to the marking device, such that it is in fluid communication with it. Such a tube-like chamber can also contain an ink follower made of a suitable material, which ensures flow of the marking substance to the marking device. FIG. 12 shows an embodiment of a marking instrument containing a marking device 2*a* attached to a tube-like marking substance-containing apparatus 4*a* which is partially filled with a marking substance 5. FIG. 12 also shows a venting apparatus 3. FIG. 29 shows a coin-like embodiment 38 containing the same elements as FIG. 12.

Alternatively, the marking substance-containing apparatus can be in the form of a reservoir-like chamber which is bag-like and contains the marking substance in a sealed manner.

Alternatively, the marking substance-containing apparatus can be in the form of a reservoir-like chamber that is a void-like area or void-like channel, which, for example, can be contained in, or constructed by, one layer or more than one layer of a laminated body. Such a void-like area or void-like channel can contain integral supporting structures made of the same material as the body, or of a material that is similar to the material of the body, and which maintain the void. Such integral supporting structures can be formed, for example, by injection molding, vacuum or pressure forming, chemical etching, laser cutting or etching, or dispensing of adhesives and curable resins.

Figure 5:
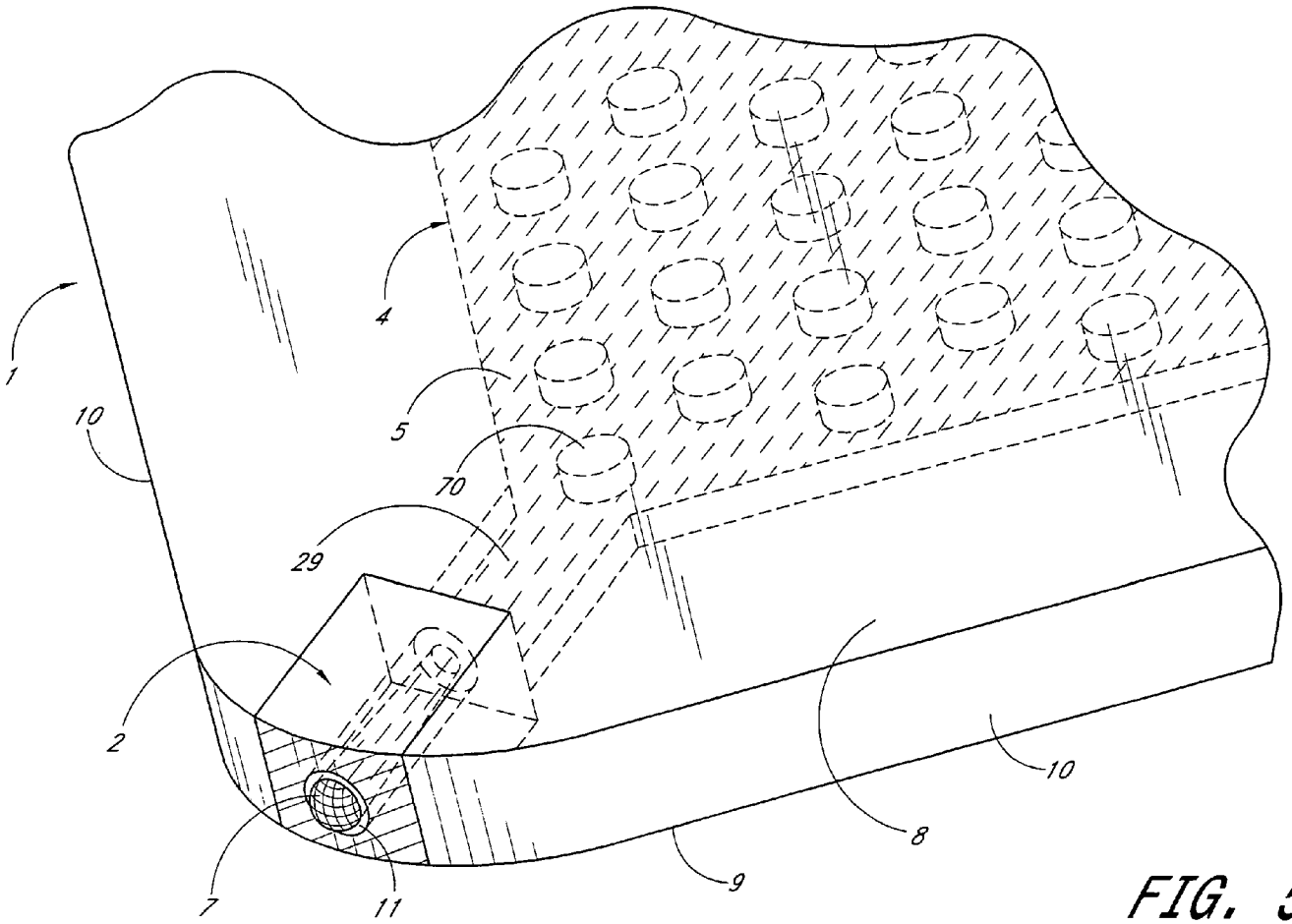
FIG. 5 is an enlarged perspective view of a marking device shown in FIG. 3 and FIG. 4.

The integral supporting structures can be arranged in a suitable pattern which forms a capillary chamber which causes the marking substance to accumulate near the marking device and be largely retained there. For example, the embodiment in FIG. 3, FIG. 4 and FIG. 5 shows a marking substance-containing apparatus 4 which contains a pattern of integral column-like supporting and capillary structures 70 and 71. The smaller diameter and closer-spaced column-like integral supporting and capillary structures 70 near the marking device 2 form a capillary chamber which draws the marking substance to the marking device and largely retains it there. The larger diameter column-like integral supporting and capillary structures 71 spaced slightly further apart also form a capillary chamber which retains the remaining supply of marking substance largely in place. The largest diameter column-like integral supporting structures 72 serve to provide larger, regularly spaced bonding surfaces for lamination of the body layers, thus preserving the structural integrity of the body. Patterns for integral supporting and capillary structures can be column-like, with the columns taking on any suitable shape, or they can be lattice-like, with the resulting channels taking on any suitable shape, or they can be of any other suitable pattern.

Alternatively, the marking substance-containing apparatus can be in the form of a reservoir-like chamber which can contain an integrated supporting structure, or integrated supporting structures, which constitute a separate layer, or separate layers, and which are made of a suitable material. Such integrated supporting structures can be formed, for example, by injection molding, vacuum or pressure forming, chemical etching, or laser cutting or etching.

Figure 17:
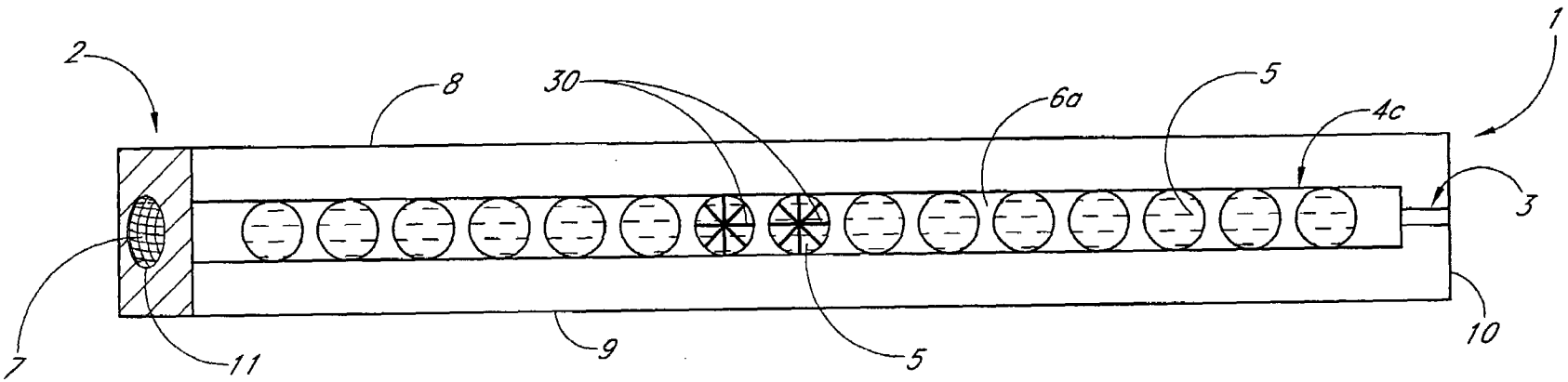
FIG. 17 is an enlarged side edge sectional elevation view (not drawn to scale) of a marking substance-containing apparatus which contains extruded supporting structures and extruded sub-structures.

Alternatively, the marking substance-containing apparatus can be in the form of a reservoir-like chamber which can contain an extruded supporting and capillary structure, or extruded supporting and capillary structures, which constitute a separate layer and which are made of a suitable material, such as a plastic, such as a homopolymer or copolymer polyacetal resin. Such an extruded supporting and capillary structure can be in a form resembling a tube-like refill, and it can have a profile resembling a tube-like refill, or it can have a profile of any other suitable shape. Alternatively, such an extruded supporting and capillary structure can contain voids in combination with additional extruded supporting and capillary sub-structures, or non-extruded supporting and capillary sub-structures, which are also of a suitable material and a suitable shape, and which serve to maintain the voids. FIG. 17 shows a marking substance-containing apparatus 4*c* which is in the form of an extruded supporting and capillary structure 6*a* containing voids which contain a marking substance 5. FIG. 17 also shows two such voids also containing, for example, star-shaped extruded supporting and capillary substructures 30, in order to provide additional structural support for maintaining the voids.

Alternatively, the marking substance-containing apparatus can be in the form of a reservoir-like chamber containing a suitable fluid mixture of marking substance and microstructures. The glass or ceramic microspheres remain in the chamber as use of the marking instrument causes the marking substance to drain through the marking-liquid delivering apparatus, and thus provide continuing support of the top and bottom walls of the chamber, and maintain the strength of the body. The shape and surface texture of the inner walls of the reservoir-like chamber can be constructed in a manner that offers suitable capillarity to ensure flow of the marking substance to the marking device.

Alternatively, the marking substance-containing apparatuses contained within the same body can be in the form of any suitable combination of the various marking substance-containing apparatuses described in this section above.

Each marking substance-containing apparatus can contain a form of venting apparatus that can enable an equalization of pressure caused by the expansion and contraction of the marking substance within the walls of the reservoir-like chamber that can be caused by changes in ambient temperature and pressure. Such a venting apparatus can take the form of one or more small holes which open up to one of the outer surfaces of the body as shown, for example, in FIG. 1 by vent 3. Such a venting apparatus can contain a suitable material which is permeable to air, but not to a marking substance. The venting apparatus can also serve as the filling point for the marking substance during manufacture of the marking instrument, and as a refilling point for marking substance once the marking substance becomes depleted from use of the marking instrument.

Alternatively, the marking device can be in the form of a sealed reservoir-like chamber, that is, without containing any form of venting apparatus, where such reservoir-like chamber can contain a suitable pressurized gas and can also contain an ink follower made of a suitable material, both of which ensure flow of the marking substance to the marking device.

Additionally, the inner wall surface of a reservoir-like chamber, and the microscopic surfaces of any extruded, or non-extruded, supporting structures or sub-structures, or the microscopic surfaces of any porous material or of any microstructures can be coated with a chemical compound which suitably alters the surface energy of the material being used, such that the marking substance can flow suitably through or over such material. Additionally, such coatings can be used to suitably affect the wetting properties of the marking substance. For example, the hydrophilicity/hydrophobicity of the material being used can be suitably adjusted, such that the wetting properties of aqueous-base marking substances can flow suitably through or over such material.

In all embodiments, the inner surface of the reservoir-like chamber, or the inner surfaces of the void-like area or void-like channel can be coated with a suitable material, such as a polypropylene plastic, or a metal such as brass or stainless steel, which serves to better contain the marking substance in the reservoir-like chamber, or in the void-like area or void-like channel, and/or inhibits permeation of air and moisture into the reservoir-like chamber, or the void-like area or void-like channel, thus protecting and preserving the marking substance. The coating can be applied by various means during manufacture of the marking substance-containing apparatus, such as by hot stamping a plastic or metal foil, precision application or spraying of liquefied plastic or metal, precision vapor deposition, or any other suitable method.

In all embodiments, in order to suit user or commercial needs or desires, the size of the marking substance-containing apparatus can be varied, and/or the amount of marking substance that is filled into the marking substance-containing apparatus can be varied, in order to provide varying longevity of the marking instrument's marking capability. Further, in all embodiments the shape of the marking substance-containing apparatus can be varied to adapt to the external configuration of the body of the marking instrument. For example, the marking substance-containing apparatus can have a rectangular, circular, or any other shape.

The marking substance can be a suitable commercially available pigmented or non-pigmented ink typically used for marking instruments. The marking substance can be a suitable commercially available pigmented or non-pigmented aqueous gel ink typically used for marking instruments. The marking substance can be a suitable commercially available pigmented or non-pigmented ink typically used in porous nib or felt pens. The marking substance can be a suitable liquid graphite which is erasable, similar to the solid graphite contained in a conventional pencil. Alternatively, the marking substance can be any other suitable chemical compound which serves to suitably mark a desired surface. Additionally, the marking substance can contain commercially desirable characteristics, such as a fluorescent color, a pastel color, a metallic color, a pearlescent color, a sparkle color, a glow-in-the-dark color, a scented color, or any other commercially desirable characteristic.

The marking substances can be filled, and refilled, into the marking substance-containing apparatus, for example by manual or mechanical insertion into the marking substance-containing apparatus, through a suitable opening in the body of the marking instrument. Such suitable opening can contain a capping or stopping device to retain the marking substances once filled. Manual or mechanical insertion of the marking substance can be achieved, for example, using a syringe-like device. Filling of the marking substance-containment apparatus can also utilize capillary action to draw the marking substance in. Once filled with a desired volume of marking substance, the marking instrument can be suitably centrifuged to accumulate the marking substance near the marking device, and to remove air pockets within the marking substance, as is conventionally done in the manufacture of marking instruments.

Alternatively, the marking substance can be deposited into the void-like area or void-like channel of a marking substance-containing apparatus via rollers, such as anilox rollers which are commonly used in flexographic and offset printing. This process can occur just prior to a lamination process which bonds the various layers of a laminated body. The laminated body of the marking instrument can then be suitably centrifuged to accumulate the marking substance near the marking device, and to remove air pockets within the marking substance, as is conventionally done in the manufacture of marking instruments.

Those skilled in the art will appreciate that the marking substance, for example, ink, interacts with inner surfaces of any ink passage or the chamber or reservoir-like apparatus 4 at the ink-surface interface. During marking on a surface, gravity and a rolling ball draw the ink from the chamber and through any passage between the ball and the chamber. These forces must overcome any adhesion of the ink within the chamber and any passage. Among other parameters, the diameter of the tip, or any ink passage, and ink characteristics, such as viscosity and surface tension, have an effect on the adhesion. Thus, those skilled in the art will appreciate that the ink and the diameters, among other parameters, are selected to draw the ink from the chamber 4 to the ball.

Marking Devices

The embodiments of the marking instrument that are in the form of a conventional financial transaction card can contain one, or more than one, marking device, in one or more suitable locations in the body, which delivers the marking substance to the surface to be written upon or marked. Alternative embodiments of the marking instrument that are fractional financial transaction card body forms, or any other commercially desired body form, can also contain one or more marking devices suitably located in the body to enable contact of the marking device(s) with the surface to be written upon or marked. In the embodiment in FIG. 1, the marking device 2 is located at one corner of the body, and the ball point mechanism it contains is nearly flush with the arc of the body corner. FIG. 3 and FIG. 5 further show that, in the same embodiment, the marking device 2 is connected to, and in fluid communication with, the marking substance-containing apparatus 4 via a fluid passage 29.

The marking device can be a suitable quality ball point mechanism, manufactured from a suitable metal, such as brass or stainless steel, or injection molded using a suitable plastic, such as a polypropylene. The marking device can be a suitable quality ball point mechanism which can prevent so-called forward leakage, that is ink drip through the ball point. Such a ball point mechanism can also prevent evaporation of ink from the marking substance-containing apparatus, and prevent ink starvation which would occur due to drawing of air through the pen point when the pen is impacted, for example, by being dropped. The diameter of the ball, and of the overall thickness of the ball point mechanism, can be smaller or greater than the thickness of the body of the marking instrument in the area proximate to the marking device, in order to suit varying user preferences for marking line width. FIG. 4 and FIG. 5 show an embodiment of a marking device 2 which contains a ball point mechanism consisting of a ball 7 and a ball retaining device 11.

Figure 18:
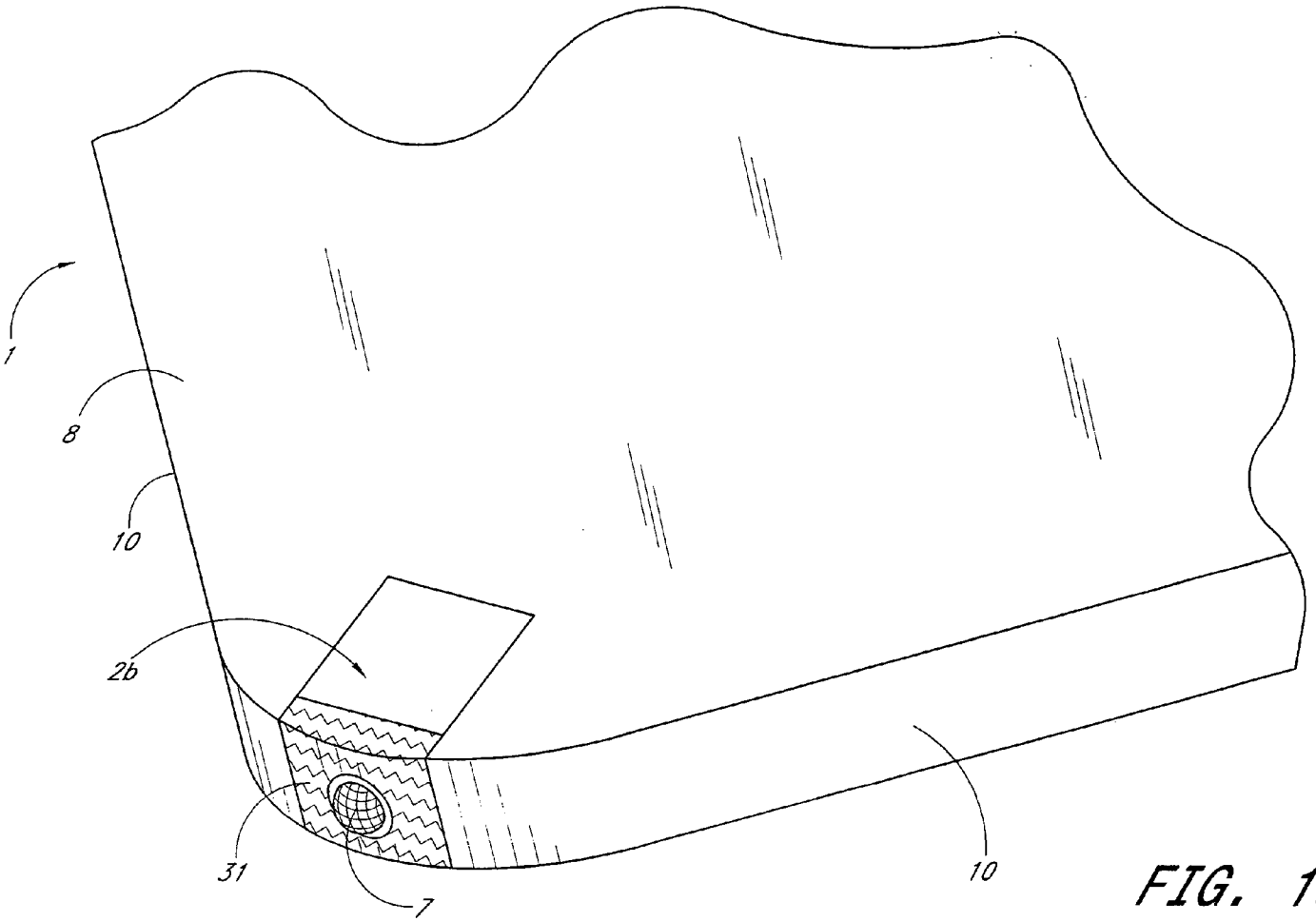
FIG. 18 is an enlarged perspective view of a marking device which contains a ball point mechanism in which the ball is retained by a precision-formed cover.

The ball point mechanism can be constructed by placing the ball in its suitable resting cavity in the ball point mechanism. The ball can then be secured in place by roll-forming the walls of the cavity around it. Alternatively, the ball can be secured by punch-forming the walls of the cavity around it. Alternatively, the ball can be secured by fixing a precision-formed cover, containing a circular hole for the ball to partially protrude through, over the ball and attaching the cover to the marking device, or to the body. FIG. 18 shows a marking device **2*b* containing a ball point mechanism with a ball 7 which is retained by a precision-formed cover 31 that is suitably attached to the marking device 2*b***.

The ball point mechanism can contain a spring-tensioned ball which can travel a small distance laterally within its socket, allowing the ball point mechanism to either allow marking substance to flow out in the gap between the ball and its socket, or to prevent the marking substance's flow when the tension of the internal spring, which is in contact with the ball, forces the ball against the wall of its socket thus closing any gaps through which the marking substance could flow.

The ball point mechanism can serve as the filling point for the marking substance prior to the insertion of the ball into the mechanism. Once the ball has been inserted into the ball point mechanism, subsequent removal of the ball can enable the ball point mechanism to serve as a refilling point for marking substance once the marking substance becomes depleted from use of the marking instrument.

The ball can be made of a suitable material, such as stainless steel or a tungsten carbide, which is conventionally used for manufacturing such balls. Alternatively, the ball can be a plastic material, such as Teflon, or a ceramic material.

Alternatively, the marking-liquid delivering mechanism can be in the form of a porous insert, such as a fiber nib or porous plastic nib, constructed of a suitable commercially available porous material conventionally used as nibs and tips for marking instruments.

The ball point mechanism, and the porous fiber nib or porous plastic nib, can contain a marking substance feeder device constructed of a suitable material, such as is conventionally used in roller ball and free ink marking instruments. A conventional ball point mechanism includes a channel system that feeds ink to the ball in the ball point mechanism. The channel system can be configured to provide for sufficient capillarity such that the ink flows in sufficient quantity to the ball. The capillarity of the channel system can be adjusted by varying, for example, the number, size and radius of the channels, and their placement around the ball, within the ball point mechanism.

Figure 9:
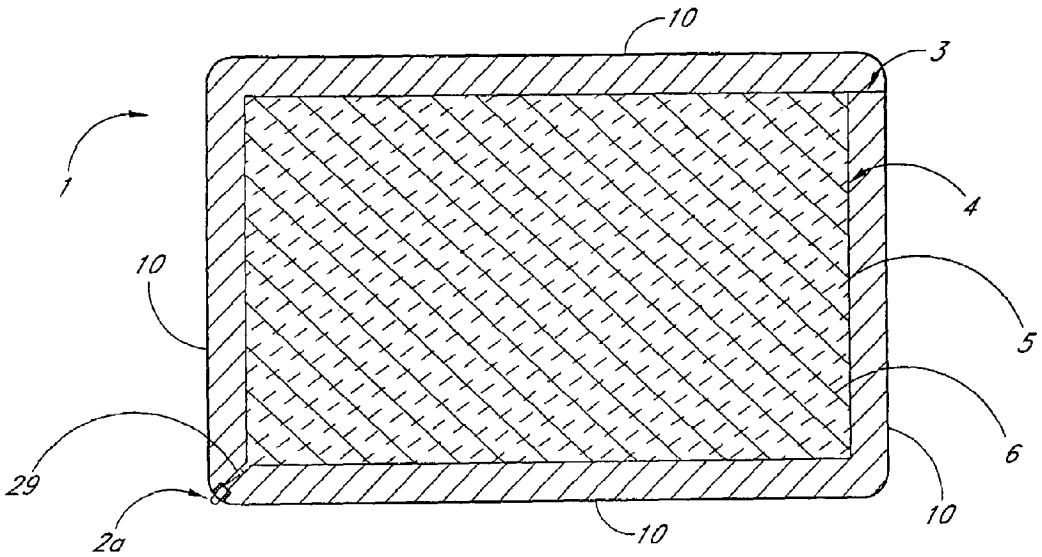
FIG. 9 is a longitudinal sectional view of the embodiment shown in FIG. 7, showing the marking substance-containing apparatus in fluid communication with the marking device.
Figure 10:
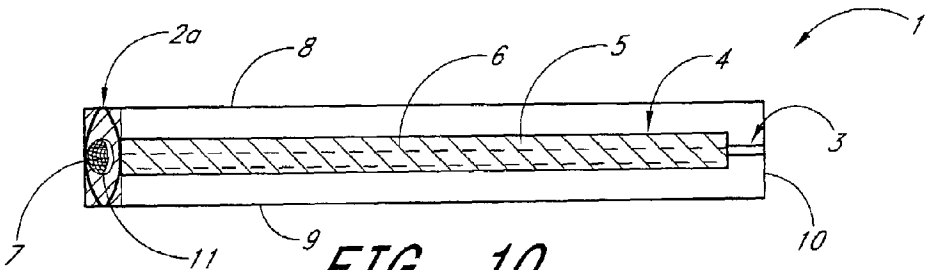
FIG. 10 is an enlarged side edge sectional elevation view (not drawn to scale) of the embodiment shown in FIG. 7, showing the internal elements contained in the body structure.
Figure 11:
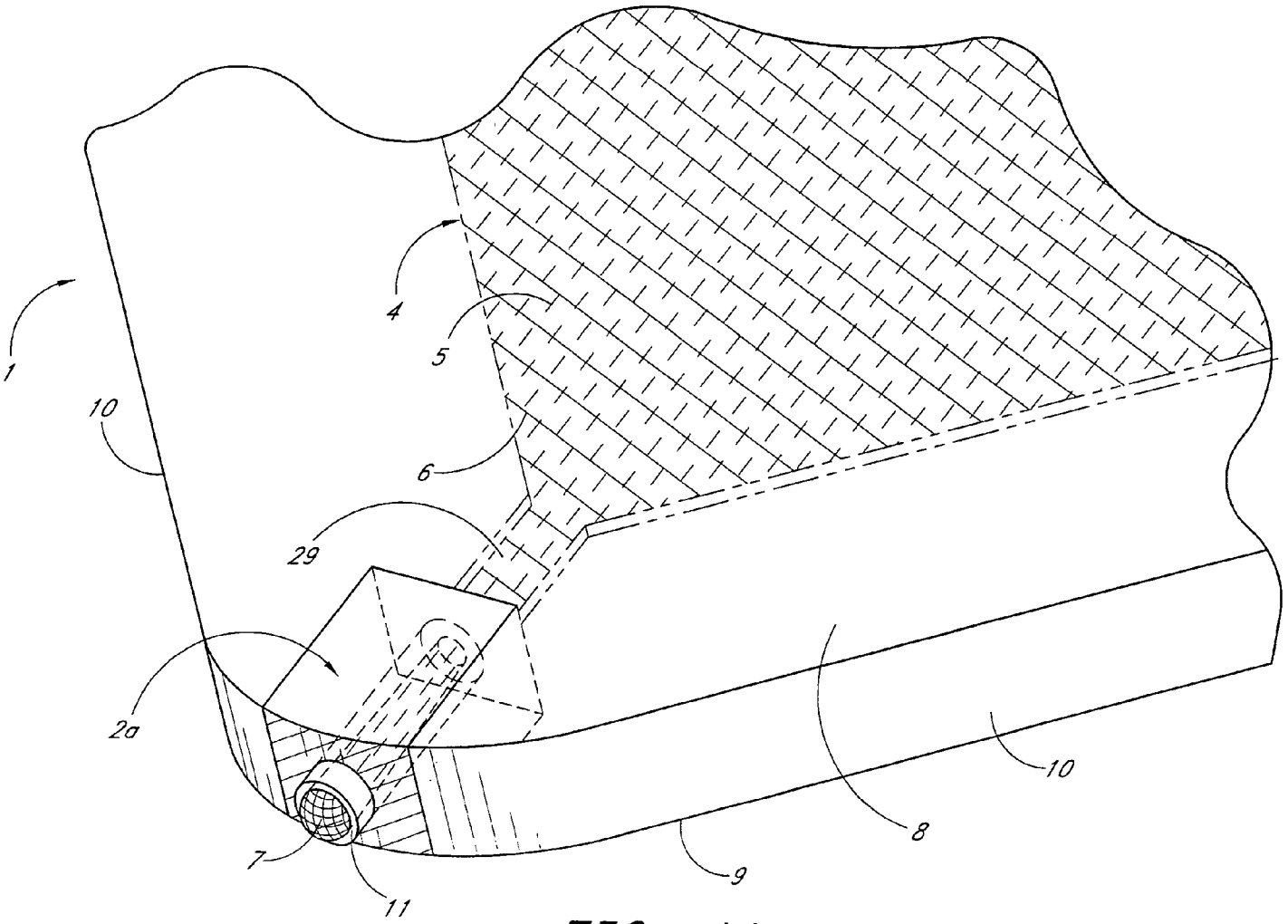
FIG. 11 is an enlarged perspective view of a marking device shown in FIG. 9 and FIG. 10.

Each marking device contained in the body of the marking instrument can protrude a suitable distance from the perimeter of the body to enable contact with the surface to be written upon or marked. In the embodiment in FIG. 7, the marking device 2*a* is located at one corner, and the ball point mechanism that it contains, consisting of a ball 7 and a ball retaining device 11, protrudes a small distance from the arc of the body corner. FIG. 9 and FIG. 11 further show that, in the same embodiment, the marking device 2*a* is connected to, and in fluid communication with, the marking substance-containing apparatus 4 via a fluid passage 29. In another embodiment, FIG. 10 and FIG. 11 show a marking device 2 which contains a ball point mechanism consisting of a ball 7 and a ball retaining device 11.

The marking device can be suitably positioned in the body using a variety of methods. For example, the marking device can be injection molded into its desired position, or it can be laminated into its desired position, as described above. Alternatively, it can be positioned by precision milling a suitable cavity in the body of the marking instrument, and then inserting the marking device into such cavity and permanently attaching it to the body and/or to a marking substance-containment apparatus using various methods, such as laminating using heat, adhesives such as commercially available epoxies and glues, lasers, or other suitable methods.

The marking device can be in the form of a mechanical device which is composed of two or more interlocking segments which can be joined, for example, by screw threads. The screw threads can enable the user to selectively rotate the marking device such that the marking tip moves from a position of projection beyond the perimeter of the body, thus facilitating contact with the surface to be written upon or marked, to a position where it is flush with the perimeter of the body, or it is recessed into the body relative to the perimeter of the body. The suitably formed rotating segment, or segments, can have a friction-generating contact surface on their outer perimeter, such as a rubberized surface or a knurled surface, and such outer perimeter can be sized such that it suitably protrudes through the plane of the body bottom surface or the plane of the body top surface, or both the plane of the body bottom surface and the plane of the body top surface.

The user can rotate such a retractable marking device by, for example, sliding a finger repeatedly in the same direction over one of the suitably formed and suitably protruding rotating segments. Alternatively, the user can rotate the retractable marking device by placing the body of the marking instrument on a flat surface, such that the protruding rotating segment, or segments, is in contact with the flat surface, and then simultaneously pressing on the body and pushing the body in the direction of clockwise rotation or counter-clockwise rotation of the rotating segment.

The body sections immediately surrounding the rotation-retractable marking device can contain a joining and stabilizing apparatus, particularly in thin bodies, which is made of a suitably strong material, such as a plastic or a metal. Such stabilizing apparatus can be in the form of end caps which suitably cover the corner, wires or bands which envelope the corner, or any other suitable form.

Figure 37:
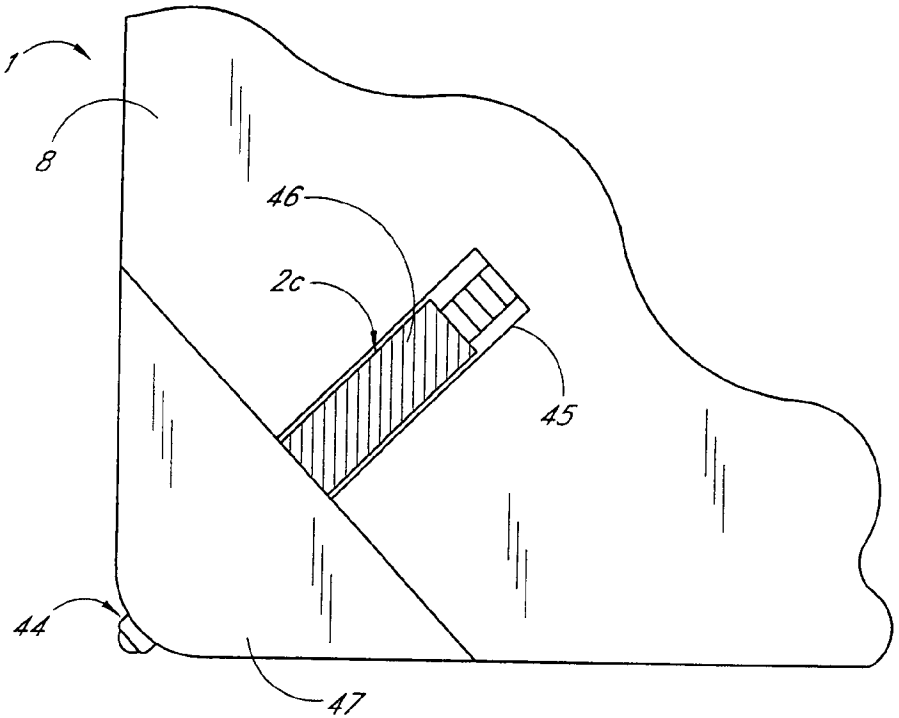
FIG. 37 is an enlarged top plan view of a marking instrument contained in a card-like device, containing one rotation-retractable marking device.

FIG. 37 shows an embodiment of a rotation-retractable marking device 2*c*, which contains a ball mechanism 44, and which is suitably located in a corner of the body 1 which contains a form-fitting void 45 to accommodate the rotation-retractable marking device. In FIG. 37 the rubberized or knurled surface 46 of the rotating segment of the rotation-retractable marking device is shown rotated clockwise to the point where the ball mechanism is fully protruded beyond the corner edge of the body and is usable for marking.

FIG. 37 also shows an embodiment of a joining and stabilizing apparatus in the form of a form-fitting end cap 47 which is made of a suitably strong material, such as a plastic or a metal, and which is fitted over the entire corner and then fixed in place, in order to join and stabilize the body sections surrounding the rotation-retractable marking device 2*c*. The end cap joiner and stabilizer can be attached to the body corner by various methods such as laminating using heat, adhesives such as commercially available epoxies and glues, laser welding, or other suitable methods.

Alternatively, instead of an actual end cap, a suitable-size drop of a suitable liquid adhesive, such as a clear epoxy, can be deposited over the same area covered by the end cap, which, once cured and hardened, will similarly join and stabilize the body sections surrounding the rotation-retractable marking device. In using this alternate method, a form-fitting sleeve made of a suitable material, such as a metal or a plastic, can be placed over the distal portion of the distal tube-like segment of the rotation-retractable marking device, such that the distal tube-like segment is protected from the liquid adhesive, and can continue to rotate freely under it.

Figure 38:
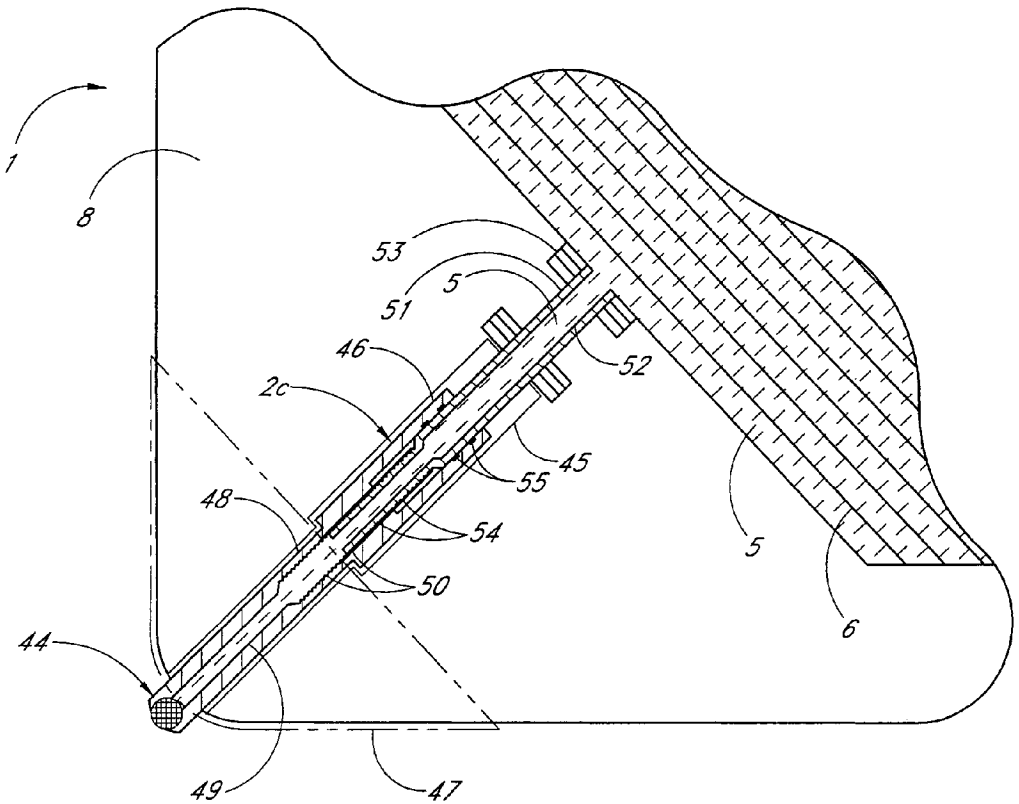
FIG. 38 is an enlarged top sectional view of a rotation-retractable marking device.

FIG. 38 shows a sectional view of the embodiment in FIG. 37. The form-fitting void 45 is shown. The rotation-retractable marking device 2*c* consists of two segments. The distal tube-like segment 48 contains a ball mechanism 44, a tube-like channel 49 through which marking substance 5 can flow to the ball mechanism from the porous-material reservoir 6, internal screw threads 50 which allow the segment to rotate, a rubberized or knurled outer surface 46 on the proximate portion of the segment, and rings of a suitable sealing material 55. Such a sealing material can be, for example, a rubber-like O-ring or washer-like gasket, or it can be a Teflon O-ring or washer-like gasket. The proximate tube-like segment 51 is fixed in place in the body and does not rotate, and it contains a tube-like channel 52 through which marking substance 5 can flow to the ball mechanism from the porous-material reservoir 6, anchor elements 53 which secure it in position, and internal screw threads 54. FIG. 38 also shows the joining and stabilizing end cap 47.

Marking Solid-Containing Apparatuses, Marking Solids, and Marking Solid Filling Methods The body of the marking instrument can contain a marking solid-containing apparatus which can be in the form of a chamber which is configured to contain a marking solid, such as a pencil lead. The body can contain more than one marking solid-containing apparatus, and the marking solids contained in such apparatuses can all be of the same type and color, or they can be of different types and/or colors.

The marking solid can be made of a suitable compound, such as a graphite, such that it is semi-rigid and it is able to flex within a semi-rigid body.

The marking solids can be filled, and refilled, into the marking solid-containing apparatus, for example by manual or mechanical insertion into the marking solid-containing apparatus, through a suitable opening in the body of the marking instrument. Such suitable opening can contain a capping or stopping device to retain the marking solids once filled.

Marking Solid-Delivering Apparatuses

The body of the marking instrument can contain one, or more than one marking solid-delivering apparatus which is configured to suitably retain a marking solid for marking. Each marking solid-delivering apparatus can be connected to a marking solid-containing apparatus. Such a marking solid-delivering apparatus can be in the form of a conventional mechanical pencil mechanism which retains the marking solid, and which advances the marking solid by means of a suitable triggering mechanism.

The triggering mechanism can be in the form of a double clicking-type bounce device or a side knock mechanism used in conventional mechanical pencils, or it can be a rotary mechanism. Alternatively, such a triggering mechanism can be in the form of a so-called "automatic pencil" mechanism which contains a moving tip mechanism which automatically advances a marking solid as the marking solid is depleted during marking, causing the moving tip mechanism to come in contact with the surface being written upon or marked.

Retracting Apparatuses for the Marking Devices and/or Marking Substance-Containing Apparatuses The body can contain a retracting apparatus for one or more of the marking devices, and/or marking substance-containing apparatuses, it contains, for when the marking instrument is not in use. Such a retracting apparatus can enable the user to selectively, successively or simultaneously retract one or more of the marking devices, and/or marking substance-containing apparatuses, contained in the body by enabling the marking device(s) to move from a position of projection beyond the perimeter of the body, thus facilitating contact with the surface to be written upon or marked, to a position where it is flush with the perimeter of the body, or it is recessed into the body relative to the perimeter of the body. Such retracting apparatus can use a variety of triggering mechanisms, such as a double clicking-type bounce device or a side knock mechanism used in conventional retractable marking instruments, or a rotary mechanism with selectable settings Retracting Apparatuses for the Marking Solid-Delivering Apparatuses and/or Marking Solid-Containing Apparatuses The body can contain a retracting apparatus for one or more of the marking solid-delivering apparatuses, and/or the marking solid-containing apparatuses, it contains, for when the marking instrument is not in use. Such a retracting apparatus can enable the user to selectively, successively or simultaneously retract one or more of the marking solid-delivering apparatuses, and/or the marking solid-containing apparatuses, contained in the body by enabling the marking solid-delivering apparatus(es) to move from a position of projection beyond the perimeter of the body, thus facilitating contact with the surface to be written upon or marked, to a position where it is flush with the perimeter of the body, or recessed into the body relative to the perimeter of the body. Such retracting apparatus can use a variety of triggering mechanisms, such as a double clicking-type bounce device or a side knock mechanism used in conventional retractable marking instruments, or a rotary mechanism with selectable settings.

Capping Apparatuses for the Marking Devices

The body can contain a capping apparatus which enables the user to prevent the marking device(s) it contains, either selectively, successively or simultaneously, from marking surfaces when the marking instrument is not in use. The capping apparatus can be in a form that is separable and removable from the body of the marking instrument, or in a form that is integrated with and permanently attached to the body.

Figure 20:
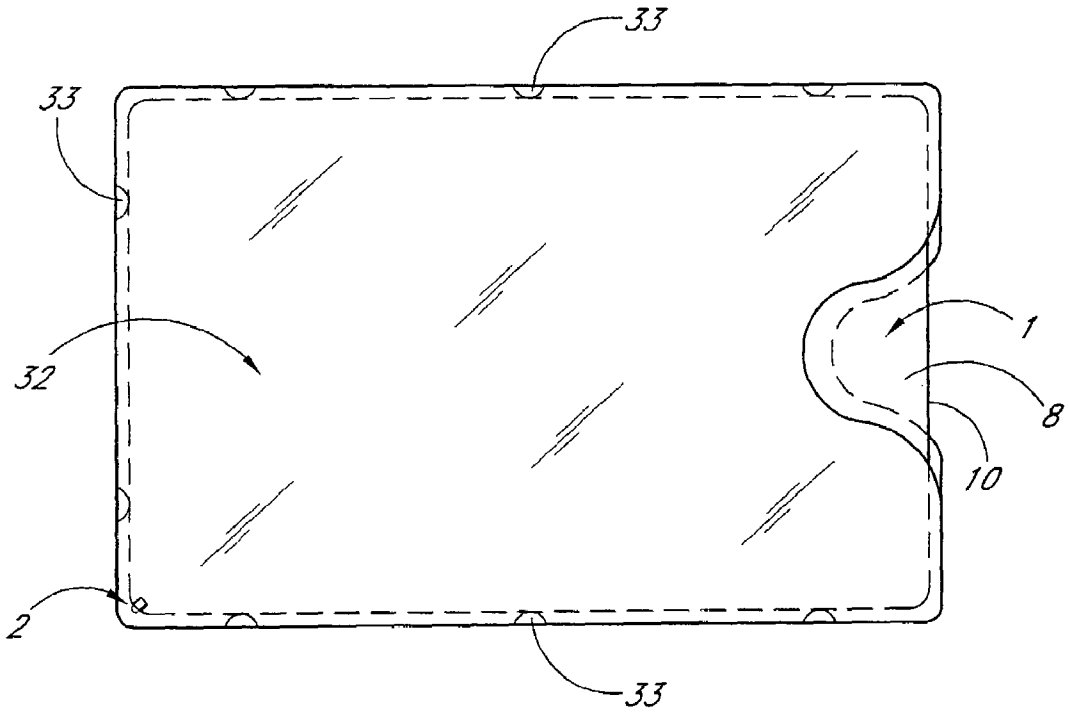
FIG. 20 is a sectional view of a capping apparatus and enclosing device for the embodiment shown in FIG. 1.

Examples of separable and removable capping apparatuses are jackets or sleeves made of a suitable material such as plastic, textiles or leather, which partially or entirely snugly surround and cover the body of the marking instrument, and thus some or all of the marking devices it contains. FIG. 20 shows an embodiment of a capping apparatus and enclosing device 32 into which the entire body 1 of the marking instrument snugly fits, thus effectively capping the marking device 2. The body 1 is further retained in the capping apparatus and enclosing device 32 by several suitably located combination friction devices and guides 33 which are an integral part of the capping apparatus and enclosing device 32. In the embodiment shown in FIG. 20, it is contemplated that the capping apparatus and enclosing device 32 is made of a suitable semi-rigid clear plastic.

Figure 33:
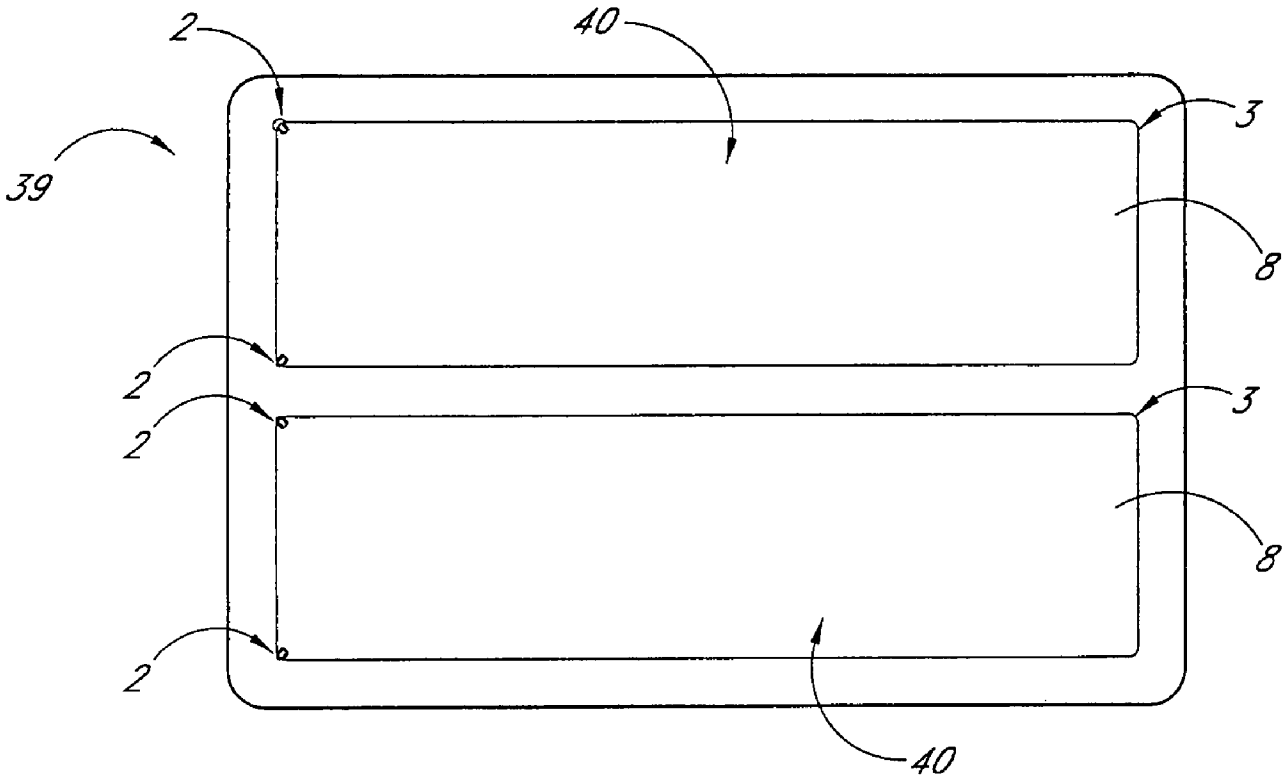
FIG. 33 is a perspective view of two fractional financial transaction card-like body form marking instruments, showing two marking devices on each marking instrument, and an apparatus for conveniently containing the marking instruments when not in use.

In another embodiment shown in FIG. 33, the separable and removable body-like capping apparatus 39 contains recesses which contain two marking instruments 40, each containing two marking devices 2, a venting apparatus 3, and a decoratable body top surface 8. It is contemplated that the marking instruments 40 can be held in place in the recesses by means of, for example, a press fit, and/or by magnetic materials contained in both the capping apparatus 39 and the marking instruments 40.

Figure 19:
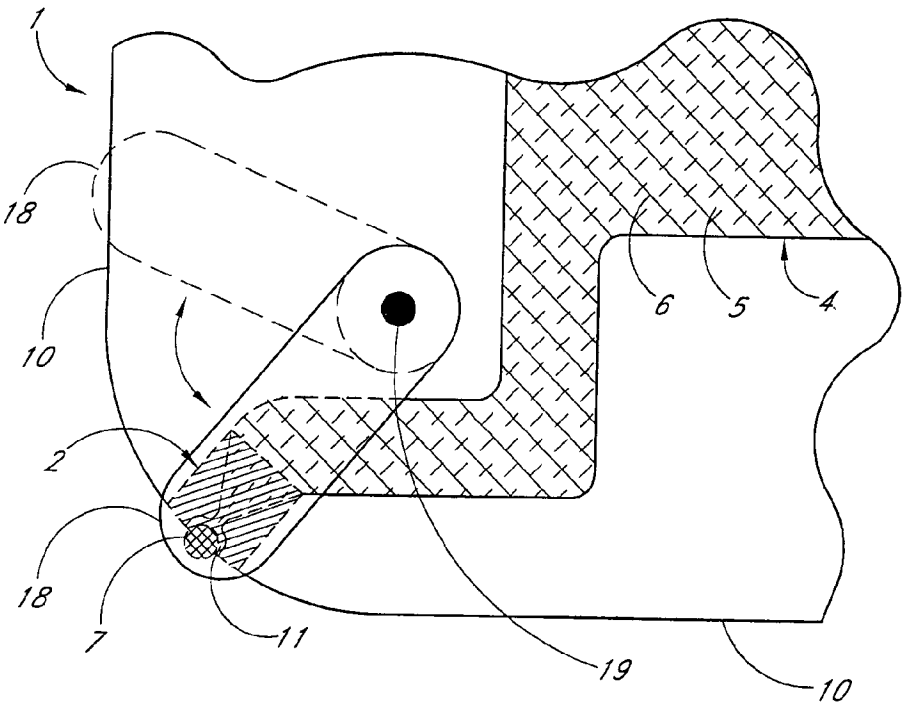
FIG. 19 is an enlarged top sectional view of a marking device with a capping apparatus that is integrated and permanently attached to the body.

Examples of integrated and permanently attached capping apparatuses are swingable, slideable or rotatable covering mechanisms that retract, slide, or rotate to selectively expose one or more of the marking devices contained. The embodiment in FIG. 19 shows an oblong circular capping apparatus 18, which can be made of a suitable material, such as a suitable metal, and which is attached to the top body surface 8 (see FIG. 1) and the bottom body surface 9 (FIG. 2) at an attachment point and pivot 19, which can also be made of a suitable material, such as a suitable metal, and which is in the form of a cylinder which extends, for example, through the entire height of the body and through both body surfaces 8 and 9. Attachment point and pivot 19 enables the oblong circular capping apparatus 18 to swing along an arc from a position where it suitably caps the marking device 2, to a position where it entirely uncaps the marking device 2 and is a suitable distance from the marking device 2 such that it does not interfere with the function of the marking device 2 while it is in use for marking.

In another embodiment, the body and the oblong circular capping apparatus 18 shown in FIG. 19 can contain additional features, such as a stopping and locking apparatus (not shown) which can enable the oblong circular capping apparatus 18 to suitably rest and lock in both the capping and uncapping positions along its swing arc. In one embodiment, the oblong circular capping apparatus 18 and such stopping and locking apparatus are made of a suitable material, or a suitably coated material, which can enable the user to conveniently move the oblong circular capping apparatus 18 from its capping to its uncapping position, and vice versa, without touching it with one or more fingers, but instead by suitably rubbing the outermost edge of the oblong circular capping apparatus 18 against a contact surface, such as the surface to be written upon or marked, in an arc-like motion.

In another embodiment, the oblong circular capping apparatus 18 shown in FIG. 19 can contain a suitable material, such as a small rubber sphere, hemisphere or sheet, which, when the oblong circular capping apparatus 18 is in the capping position, comes in direct contact with the ball and serves to cover the ball to facilitate prevention of the marking substance drying on the ball, and facilitate prevention of the marking substance evaporating from the space between the ball and the cavity in which it rests in the marking device.

In another embodiment, an integrated and permanently attached capping apparatus can be in the form of a slideable covering mechanism consisting of a continuous segmented band, or of a band of linked segments, which rests on the edge of the body and completely and snugly encircles the edge of the body. One suitably sized length of the slideable covering mechanism can contain a hole or a void, such that when it is slid directly over the location of one of the marking devices, it functions to uncap that marking device. The slideable covering mechanism can be made of a suitable material, such as a clear plastic. Alternatively, the ends of the continuous segmented band, or of the band of linked segments, can be suitably joined by a connecting device, the length of which allows for the uncapping of the marking device when the connecting device is appropriately positioned at the marking device.

Figure 21:
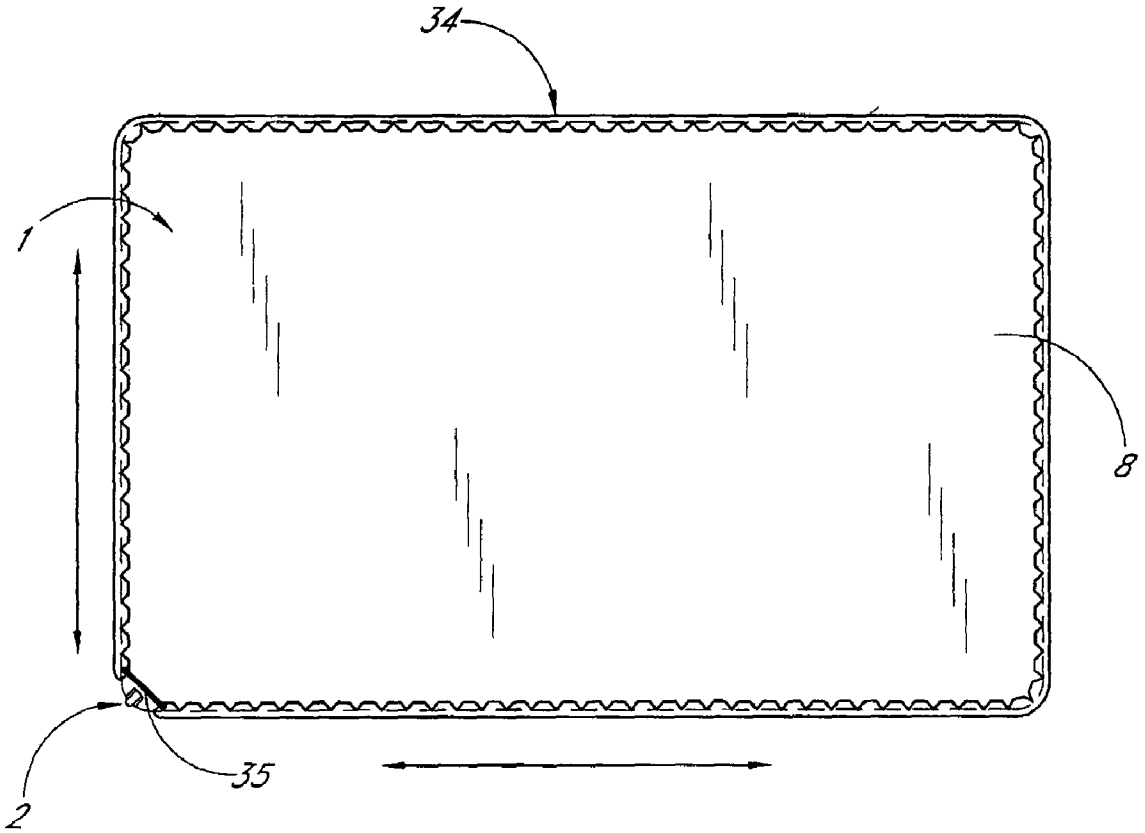
FIG. 21 is a top plan view of a slideable capping apparatus in the form of a continuous segmented band joined at its ends with a connecting device.

The embodiment shown in FIG. 21 shows a permanently attached capping apparatus which is in the form of a continuous segmented band 34, which snugly covers the edge of the body 1, and the segmented portions of which extend slightly over both the body top decoratable surface 8 and the body bottom decoratable surface 9 (on the rear side). The continuous segmented band 34 is permanently joined at both ends by the connecting device 35, and can be selectively slid, by the user, in the directions indicated by the arrows, such that the position of the connecting device 35 serves to either cap or uncap the marking substance-delivering device 2. It is contemplated that the internal surface of the continuous segmented band, or the internal surface of the band of linked segments, which is in contact with the edge of the body and which slides along it, can contain suitable spacing elements, such as integral convex hemispheres suitably located, such that contact of the internal surface of the bands with the ball point, during sliding of the band in either direction, is reduced, or is prevented.

Attachment Apparatuses

Figure 22:
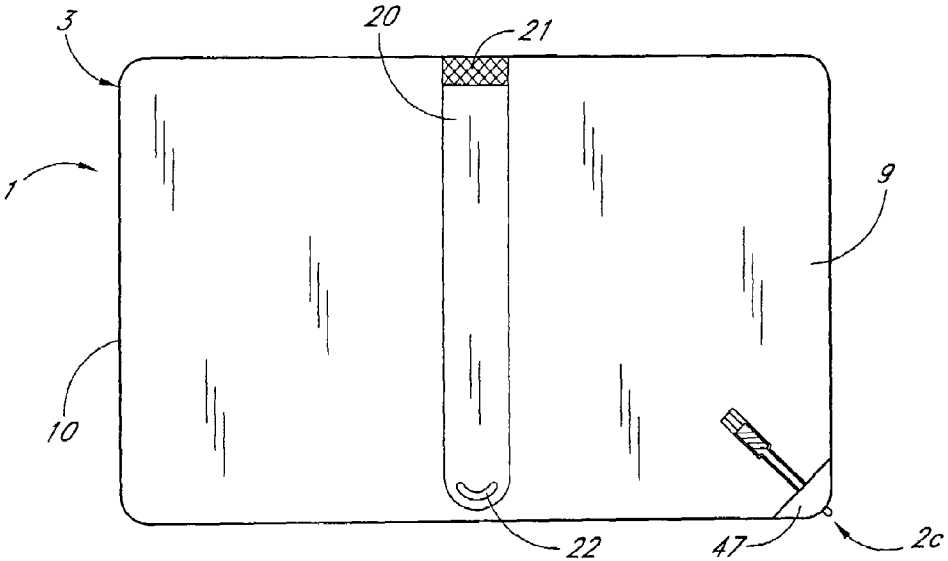
FIG. 22 is a perspective view of a marking instrument with a retractable marking device and an integrated clip apparatus.
Figure 23:
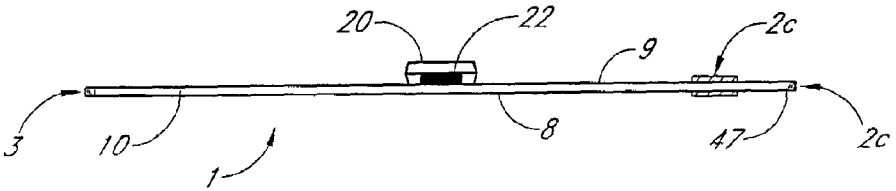
FIG. 23 is a side edge elevation view of the marking instrument and integrated clip apparatus shown in FIG. 22.

The body 1 can contain one or more attachment apparatuses enabling attachment of the marking instrument to a pocket, key ring, lanyard, or similar devices. Such apparatus can be in the form of a clip apparatus which is integrated with and permanently attached to the body, such as the embodiments shown in FIG. 22 and FIG. 23, and in FIG. 24 and FIG. 25. The embodiment in FIG. 22 and FIG. 23 shows a clip 20 which can be made of the same material as the body 1, which is approximately the same thickness as the body material and which spans nearly the entire width of the body, and which is permanently attached to the body at the attachment area 21 suitably located on the decoratable body bottom surface 9. FIG. 22 and FIG. 23 also show a rotating retractable marking device 2*c*, and a joining and stabilizing end cap 47. FIG. 23 shows all the elements shown in FIG. 22 and also one decoratable body top surface 8.

The clip 20 contains a friction device 22 in the form of an indentation which serves to raise the end of the clip opposite to the attachment area a suitable distance from the body, in order to facilitate flexing the clip away from the bottom surface of the body and sliding the clip over a desired attachment surface, such as a shirt pocket, and which serves to provide a pinching and friction point of contact with the desired attachment surface to reduce slippage of the clip, and thus the body to which it is attached, from the desired point on the desired attachment surface. Since both the body bottom surface 9 and the body top surface 8 are likely to be decorated in various ways, in other embodiments the clip 20 can be made of a clear transparent material, such as a clear transparent plastic, thus preventing the clip from obscuring any portion of the decoration on the body surface to which it is attached.

In other embodiments, the clips can be made of yet other materials that are either the same material used in the body, or a material that is different from that used in the body. In other embodiments the clip can suitably vary in form, rigidness, length and thickness, the attachment area can suitably vary in size, and the shape and height of the friction point can suitably vary. The clip can be attached to the body using various methods such as laminating using heat, adhesives such as commercially available epoxies and glues, lasers, or other suitable methods. Further, it is contemplated that in another embodiment the clip 20 may be detachable.

Figure 24:
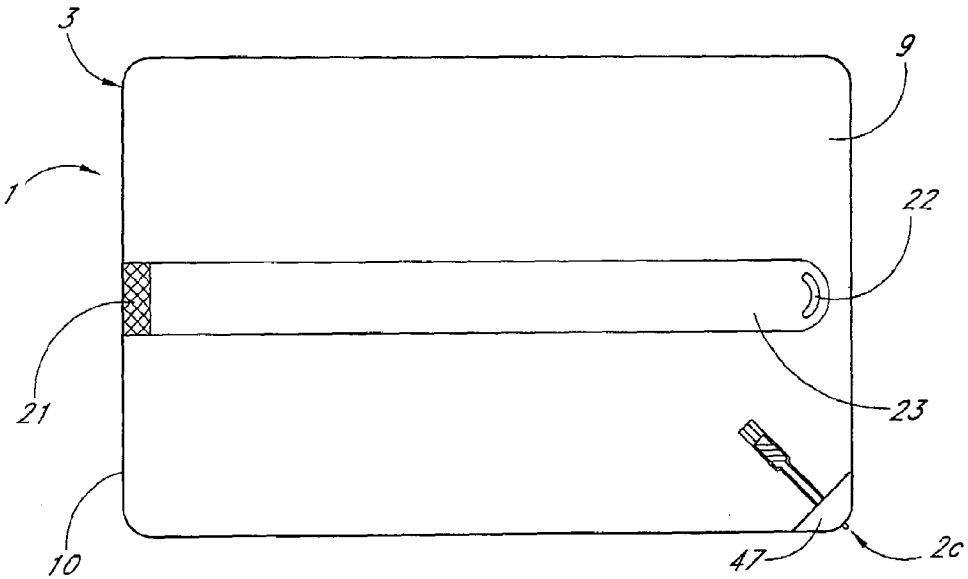
FIG. 24 is a top plan view of a marking instrument with a retractable marking device and another embodiment of an integrated clip apparatus.
Figure 25:
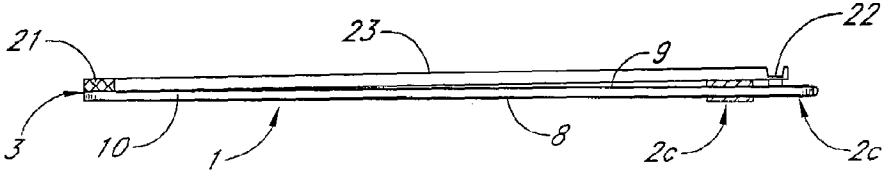
FIG. 25 is a side edge elevation view of the marking instrument with an integrated clip apparatus shown in FIG. 24.

FIG. 24 and FIG. 25 show another embodiment of a clipping apparatus in which the clip 23 spans nearly the entire length of the body 1, is attached to the decoratable body bottom surface 9 at the attachment area 21, and contains a friction device 22. FIG. 24 and FIG. 25 also show a rotating retractable marking device 2*c*, and a joining and stabilizing end cap 47. FIG. 25 also shows the decoratable body top surface 8.

In other embodiments, the clipping apparatus can be formed from the body itself by suitably die stamping or die cutting the body such that a flexible flap is formed which can serve as a clip.

It is contemplated that the embodiments shown in FIG. 22 and FIG. 23, and in FIG. 24 and FIG. 25 can also be used as a combination marking instrument and bookmark.

In addition to the preferred and alternate embodiments of the marking instrument, a skilled artisan will recognize that the marking instrument may advantageously include any, some, or all of the features and aspects discussed in the foregoing description of FIGS. 1-44. Additionally, other combinations, omissions, substitutions and modifications will be apparent to the skilled artisan in view of the disclosure herein. Accordingly, the present invention is not intended to be limited by the reaction of the described embodiments, but is to be defined by reference to the appended claims.

What is claimed is:

1. A handheld marking instrument, comprising:

a substantially flat body comprising:

a substantially flat top wall having an inner surface and an outer surface, wherein the outer surface is in contact, when in use, with a part of a user's hand, a substantially flat bottom wall having an inner surface and an outer surface, wherein the outer surface is in contact, when in use, with another part of the user's hand, and an intermediate layer between the inner surface of the top wall and the inner surface of the bottom wall, and in contact with the inner surfaces, the substantially flat body further comprising at least one edge between the top wall and the bottom wall;

a chamber in the intermediate layer, wherein the chamber extends through the intermediate layer from the inner surface of the top wall to the inner surface of the bottom wall of the substantially flat body, and wherein the chamber is configured to contain a marking substance within the substantially flat body;

a marking device configured to deliver the marking substance to a desired surface during marking, wherein the marking device is in communication with the chamber to access the marking substance, and wherein the marking device is located at least partially within the edge of the substantially flat body; and at least one vent in fluid communication with the chamber, wherein the vent provides at least for equalization of pressure between the chamber and ambient air wherein the vent is open or semi-permeable and is located at a distance from the marking device.

2. The instrument of claim 1, wherein the substantially flat body is selected from a group consisting of a rectangular shape, a square shape, a circular shape, an oval shape, a polygonal shape, and a theme-based shape.

3. The instrument of claim 1, wherein the chamber comprises at least one support structure configured to resist deformation of the chamber.

4. The instrument of claim 1, wherein the substantially flat body is coin-shaped and wherein the marking device is exposable at the edge of the coin-shaped body.

5. The instrument of claim 4, further comprising a pointing device located at the edge of the coin-shaped body at a distance from the marking device.

6. The instrument of claim 5, further comprising a capping mechanism rotatably mounted to the coin-shaped body to move between an active position exposing the marking device and an inactive position covering the marking device.

7. The instrument of claim 4, further comprising a capping mechanism rotatably mounted to the coin-shaped body to move between an active position exposing the marking device and an inactive position covering the marking device.

8. A method of manufacturing a handheld marking instrument, comprising:

providing a flat housing part comprising:

a top portion having an inner surface and an outer surface, wherein the outer surface of the top portion faces in use a part of a user's hand, a bottom portion having an inner surface and an outer surface, wherein the outer surface of the bottom portion faces in use another part of the user's hand, and an intermediate portion between the inner surface of the top portion and the inner surface of the bottom portion, and in contact with the inner surfaces;

forming a first chamber in the intermediate portion wherein the first chamber extends through the intermediate portion so that the first chamber extends through the intermediate portion from the inner surface of the top portion to the inner surface of the bottom portion, the first chamber within the housing configured to receive and contain a marking substance; and fitting a first marking device to a location of the housing to place the first marking device in communication with the first chamber.

9. The method of claim 8, further comprising laminating a top portion to the housing.

10. The method of claim 8, further comprising providing a vent in communication with the first chamber.

11. The method of claim 8, further comprising filling a marking substance into the first chamber.

12. The method of claim 11, further comprising centrifuging the housing to direct the marking substance towards the first marking device.

13. The method of claim 8, wherein at least one segment of the handheld marking instrument is formed by injection molding.

14. A handheld marking instrument, comprising:

a substantially flat body comprising:

a substantially flat top portion having an inner surface and an outer surface, wherein the outer surface faces in use a part of a user's hand, a substantially flat bottom portion having an inner surface and an outer surface, wherein the outer surface faces in use another part of a user's hand, and an intermediate portion between the inner surface of the top portion and the inner surface of the bottom portion and in contact with the inner surfaces, the substantially flat body further comprising at least one edge between the outer surface of the top portion and the outer surface of the bottom portion;

at least one chamber extending through the intermediate portion wherein the chamber extends through the intermediate portion from the inner surface of the top portion to the inner surface of the bottom portion of the substantially flat body, and wherein the chamber is configured to contain a marking substance within the substantially flat body; and a marking device configured to deliver the marking substance to a desired surface during marking, wherein the marking device is in communication with the chamber to access the marking substance, and wherein the marking device is located at least partially within the edge of the substantially flat body.

* * * * *